US008517581B2

(12) United States Patent
Futami

(10) Patent No.: US 8,517,581 B2
(45) Date of Patent: Aug. 27, 2013

(54) VEHICLE LIGHT WITH LED LIGHT SOURCE

(75) Inventor: Takashi Futami, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 307 days.

(21) Appl. No.: 12/945,830

(22) Filed: Nov. 12, 2010

(65) Prior Publication Data

US 2011/0122637 A1 May 26, 2011

(30) Foreign Application Priority Data

Nov. 12, 2009 (JP) ..... 2009-259176
Nov. 13, 2009 (JP) ..... 2009-260109
Nov. 13, 2009 (JP) ..... 2009-260110

(51) Int. Cl.
*F21V 7/00* (2006.01)
*F21V 19/00* (2006.01)

(52) U.S. Cl.
USPC ..... 362/518; 362/519

(58) Field of Classification Search
CPC ..... F21S 48/1159; F21S 48/1388
USPC ..... 362/517, 518
See application file for complete search history.

(56) References Cited

U.S. PATENT DOCUMENTS 6,367,954 B1 * 4/2002 Futami ..... 362/297
6,948,836 B2 * 9/2005 Ishida et al. ..... 362/516
7,097,334 B2 * 8/2006 Ishida et al. ..... 362/516
7,114,837 B2 * 10/2006 Yagi et al. ..... 362/523
7,232,247 B2 * 6/2007 Yatsuda et al. ..... 362/538
7,325,954 B2 * 2/2008 Futami ..... 362/538
7,484,872 B2 * 2/2009 Yatsuda et al. ..... 362/538
7,563,008 B2 * 7/2009 Chinniah et al. ..... 362/538
2005/0231971 A1 10/2005 Ishida
2007/0121081 A1 * 5/2007 Wu ..... 353/53
2009/0316423 A1 * 12/2009 Futami ..... 362/517

FOREIGN PATENT DOCUMENTS

JP 2002-245816 A 8/2002
JP 2005-294166 A 10/2005

* cited by examiner

*Primary Examiner* — Anh Mai
*Assistant Examiner* — Britt D Hanley
(74) *Attorney, Agent, or Firm* — Kenealy Vaidya LLP

(57) ABSTRACT

A vehicle light can include an LED light source disposed such that the optical axis of the LED light source is directed downward, a first lens disposed forward of the LED light source, a second lens disposed below and forward of the first lens, and a first reflector extending from both sides of the LED light source to a position near the optical axis of the LED light source. The first reflector can be configured to reflect light beams from the LED light source toward the first lens so as to form a wide vertically converged and horizontally diffused light distribution pattern. The vehicle light can include a second reflector disposed at a position below and forward of the first reflector. The second reflector can be configured to reflect light beams from the LED light source toward the second lens so as to form a middle-area vertically converged and horizontally diffused light distribution pattern. The lens can be formed by a toroidal lens that is horizontally elongated and that is formed by horizontally extending an aspherical lens cross section having a focus near the LED light source in an arc shape, or by a cylindrical lens having a horizontal focus line. In particular, the lens can be formed by an upper-half lens portion of such a toroidal lens. The vehicle light can include a light shielding shutter having a first upper edge portion and a second upper edge portion lower than the first upper edge portion.

36 Claims, 21 Drawing Sheets

VEHICLE LIGHT WITH LED LIGHT SOURCE

This application claims the priority benefit under 35 U.S.C. §119 of Japanese Patent Applications No. 2009-259176 filed on Nov. 12, 2009, No. 2009-260109 filed on Nov. 13, 2009, and No. 2009-260110 filed on Nov. 13, 2009, which are hereby incorporated in their entirety by reference.

TECHNICAL FIELD

The presently disclosed subject matter relates to a vehicle light, and in particular, to a vehicle light with reduced number of components. Furthermore, the presently disclosed subject matter relates to a vehicle light that can utilize a lens such as a toroidal lens or a cylindrical lens with a characteristic shape so that "glare light", that may occur when light beams are directed above a horizontal line H-H and near the opposite vehicle side of the road, can be prevented or suppressed. Still further, the presently disclosed subject matter relates to a vehicle light that can prevent or suppress the generation of partially colored light distribution (in particular, blue colored) formed near a cut-off line.

BACKGROUND ART

Conventional vehicle lights utilizing an LED light source have been developed to be provided with various optical systems and system configurations, thereby providing a desired light distribution pattern. For example, a vehicle light 200 as shown in FIG. 1 utilizes a plurality of optical units including light converging units 210, middle diffusion units 220, a large diffusion unit 230, and the like. The vehicle light 200 configured as described above can provide a spot light distribution pattern P1, a middle-area light distribution pattern P2, a wide-area light distribution pattern P3, and the like partial light distribution patterns, thereby forming a synthesized light distribution pattern as a whole. (See, for example, Japanese Patent Application Laid-Open No. 2005-294166.)

In the above vehicle light 200, however, the respective optical units, including the light converging units 210, the middle diffusion units 220, and the large diffusion unit 230, are typically separately designed with different specifications. Furthermore, the optical units typically have respective LED light sources separate from each other. Accordingly, there are problems in that design burden and the number of components increase, thereby increasing the entire cost.

The presently disclosed subject matter was devised in view of these and other problems and features and in association with the conventional art. According to an aspect of the presently disclosed subject matter, a vehicle light can be composed of a fewer number of components when compared with similar conventional vehicle lights, while being configured to suppress cost increase in terms of design and part number.

Further, a vehicle light utilizing a cylindrical lens has been proposed, wherein the vehicle light is provided with an optical member, in particular, a light shielding member with a specific shape so that a desired light distribution pattern is formed. (See, for example, Japanese Patent Application Laid-Open No. 2002-245816.)

For example, suppose that if a vehicle light with a projector type optical unit utilizes a toroidal lens or a cylindrical lens, a plate light shielding shutter having a straight upper edge is adopted. In this case, since the focus of such a toroidal lens is a point focus or a group focus having focuses in an arc shape (strictly, due to the shape of the toroidal lens), light beams may be disadvantageously distributed in an area $P1_R$ as shown in FIG. 19 above the horizontal line H-H and near the opposite or oncoming vehicle road side, leading to generation of glare light.

The presently disclosed subject matter was devised in view of these and other problems and features and in association with the conventional art. According to another aspect of the presently disclosed subject matter, a vehicle light, even when utilizing a toroidal lens or a cylindrical lens, can prevent or suppress the generation of glare light that may arise due to a light distribution located above the horizontal line H-H and near the opposite vehicle road side.

Further, in a vehicle light utilizing a projector type optical unit or a light converging and imaging lens (for example, an aspherical lens, a toroidal lens, and the like), as shown in FIG. 11, suppose that the light beam Ray1 from the LED light source 10 (including the case where Ray1 includes direct light from the LED light source 10) enters the lower-half lens portion $L_b$ below its optical axis from the diagonally upper side. In this case, the light beam Ray1 may be diffused and its blue component $Ray1_B$ (having longer wavelengths) may be refracted and projected in a diagonally upward direction by the action of the lower-half lens portion $L_b$. This configuration can distribute the light beam $Ray1_B$ near the cut-off line CL of the light distribution pattern as shown in FIGS. 12 and 13, meaning that the area is colored blue. This colored area may impair the light distribution pattern in terms of white color specification in accordance with a certain regulation as shown in FIG. 14 (the mark triangle is positioned outside the regulated area for white-color).

The presently disclosed subject matter was devised in view of these and other problems and features and in association with the conventional art. According to still another aspect of the presently disclosed subject matter, a vehicle light can prevent or suppress the generation of colored area (for example, blue) in a desired light distribution pattern near its cut-off line caused by the direct light from an LED light source or reflected light therefrom that enters a lower-half portion of a lens below its optical axis from the diagonally upper side. The optical axis can be a central axis along and about which light is centrally directed by the lens.

SUMMARY

According to still another aspect of the presently disclosed subject matter, a vehicle light can include: an LED light source having an optical axis as a light emitting direction, disposed so as to be inclined with respect to a vertical axis; a first lens disposed forward of the LED light source; a second lens disposed below or above, and forward of the first lens; a first reflector disposed at a position opposite to the first lens with the LED light source therebetween so as to extend from both sides of the LED light source to a position near the optical axis of the LED light source, the first reflector configured to reflect light beams from the LED light source toward the first lens so as to form a wide light distribution pattern vertically converged and horizontally diffused; a second reflector disposed at a position below or above, and forward of the first reflector and opposite to the second lens with the LED light source therebetween, the second reflector configured to reflect light beams from the LED light source toward the second lens so as to form a middle-area light distribution pattern vertically converged and horizontally diffused.

In particular, the LED light source can be disposed so as to direct the optical axis downward; the second lens can be disposed below and forward of the first lens; and the second reflector can be disposed at a position below and forward of the first reflector.

When forming a synthesized light distribution pattern including a wide-area light distribution pattern and a middle-area light distribution pattern, such a conventional vehicle light as described above has required LED light sources for forming the wide-area light distribution pattern and the middle-area light distribution pattern, respectively. Namely, the vehicle light is usually provided with a large diffusion unit and a middle diffusion unit each having at least one LED light source. On the contrary, the vehicle light according to the above aspect can be composed of various reflectors and lenses appropriately designed and arranged so as to form an optimized, synthesized light distribution pattern including a wide-area light distribution pattern and a middle-area light distribution pattern with a common single LED light source. Accordingly, when compared with the conventional vehicle light, the vehicle light according to the above aspect can prevent the cost increase in terms of designing and parts number.

In the above configuration, the LED light source can be disposed so as to direct the optical axis upward; the second lens can be disposed above and forward of the first lens; and the second reflector can be disposed at a position above and forward of the first reflector.

In the vehicle light configured as described above, the first reflector can be a revolved ellipsoidal reflector having a first focus and a second focus, the first focus can be disposed at or near, i.e., substantially at, the LED light source, and the second focus can be disposed between the first lens and the first reflector. The second reflector can be a revolved ellipsoidal reflector having a first focus and a second focus, the first focus can be disposed at or near the LED light source, and the second focus can be disposed between the second lens and the second reflector. The first reflector and the second reflector may be formed by other reflecting shapes having a free curved surface.

The vehicle light configured as described above can include at least one of a first light shielding shutter and a second light shielding shutter. The first light shielding shutter can have an upper edge and can be disposed between the first lens and the first reflector so that the upper edge is disposed at or near a focus of the first lens. The second light shielding shutter can have an upper edge and can be disposed between the second lens and the second reflector so that the upper edge is disposed at or near a focus of the second lens.

The above configuration can provide a wide-area light distribution pattern and a middle-area light distribution pattern each having a clear cut-off line defined by the respective upper edges of the first and second light shielding shutters.

Herein, at least one of the first and second light shielding shutters can be configured to have a first upper edge portion of the upper edge near the opposite vehicle road side is made higher than a second upper edge portion of the upper edge near the travelling road side.

The vehicle light configured as described above can further include a third lens disposed below (or above when the second lens is disposed above the first lens) and forward of the second lens and a third reflector disposed below (or above when the second reflector is disposed above the first reflector) and forward of the second reflector. The third reflector can be configured to reflect light beams from the LED light source toward the third lens so as to form a spot light distribution pattern vertically converged and horizontally diffused.

When forming a synthesized light distribution pattern including a wide-area light distribution pattern, a middle-area light distribution pattern, and a spot light distribution pattern, such a conventional vehicle light is typically provided with a light converging unit, a large diffusion unit and a middle diffusion unit each having at least one LED light source. On the contrary, the vehicle light according to the above aspect can be composed of various reflectors and lenses appropriately designed and arranged so as to form an optimized, synthesized light distribution pattern including a wide-area light distribution pattern, a middle-area light distribution pattern, and a spot light distribution pattern with a common single LED light source. Accordingly, when compared with the conventional vehicle light, the vehicle light according to the above aspect can prevent the cost increase in terms of designing and parts number.

The vehicle light configured as described above can further include fourth lenses disposed below and forward of the first lens and on either side of the second lens, and a fourth reflector disposed above the first reflector and the fourth lens so as to extend to cover both the sides of the LED light source. The fourth reflector can be configured to reflect light beams from the LED light source toward the fourth lens so as to form an additional middle-area light distribution pattern vertically converged and horizontally diffused.

The above configuration can provide such an additional middle-area light distribution pattern formed by vertically converging and horizontally diffusing light beams.

The vehicle light configured as described above can further include fifth lenses disposed on either side of the third lens, and fifth reflectors disposed on either side of the third reflector. The fifth reflector can be configured to reflect light beams from the LED light source toward the fifth lens so as to form an overhead-sign visible light distribution pattern horizontally diffused.

The above configuration can provide an overhead-sign visibility type light distribution pattern for a driver to be capable of visually confirming various overhead signs during travel.

Furthermore, the above-mentioned respective configurations can reduce the number of components.

In vehicle lights configured as described above, at least one of the first lens and the second lens can be shaped in an upper-half lens shape above or almost above its optical axis.

In this case, the first lens and/or the second lens can be formed by an upper-half lens portion of a toroidal lens that is horizontally elongate, the upper half-lens portion being only that portion typically located above or almost above the optical axis thereof, and the toroidal lens can be formed by horizontally extending an aspherical lens cross section having a focus near the LED light source in an arc shape. The lens can also be described as being non-symmetric in cross section about the optical axis, as the lens is viewed from a side thereof in cross section (for example see FIGS. 7, 10 and 11). In other words, the optical axis is located in a lower portion of the lens when viewed from the side in cross section, as shown in FIG. 7. More specifically, the lens is wider in a direction parallel with the optical axis at a lowermost portion of the lens when viewed from the side in cross section, as shown in FIG. 7, and is narrower in a direction parallel with the optical axis at an uppermost portion of the lens when viewed from the side in cross section, as shown in FIG. 7. In addition, the widest portion of the lens in a direction parallel with the optical axis as viewed from the side in cross section is located between the uppermost portion and lowermost portion, and closer to the lowermost portion than the uppermost portion.

In another mode, the first lens and/or the second lens can be formed by an upper-half lens portion of a cylindrical lens that is horizontally elongate, the upper half-lens portion being that portion located above or almost above the optical axis thereof, and the cylindrical lens can have a horizontally extended focus line near the LED light source.

The above configuration has dealt with the case where the optical axis of the LED light source is directed downward and the respective lenses, reflectors, and light shielding shutters are arranged with respect to the basic position of the LED light source. However, the presently disclosed subject matter can include an up-side-down configuration, namely, the optical axis of the LED light source can be directed upward and the respective lenses, reflectors, and light shielding shutters can be arranged on the basis of the up-side-down LED light source position. In this case, the unique arrangement of the lenses that can be observed from its front side can be utilized to enhance the aesthetic feature of a vehicle body.

According to still another aspect of the presently disclosed subject matter, a vehicle light can include: an LED light source; a first lens formed of at least part of a toroidal lens or a cylindrical lens, the toroidal lens being formed by horizontally extending an aspherical lens cross section having a focus near the LED light source in an arc shape, the cylindrical lens having a horizontally extended focus line near the LED light source; a reflector disposed at a position opposite to the first lens with the LED light source therebetween, the reflector configured to reflect light beams from the LED light source toward the first lens so as to form a predetermined light distribution pattern; and a light shielding shutter that has an upper edge and can be disposed between the first lens and the reflector so that the upper edge is disposed at or near a focus of the first lens, the light shielding shutter having a first upper edge portion and a second upper edge portion of the upper edge with the first upper edge portion being higher than the second upper edge portion.

The above configuration can prevent upward light beams that are directed toward the opposite vehicle road side by the action of the first upper edge portion (near the opposite vehicle road side) being higher than the second upper edge portion of the light shielding shutter. Accordingly, while utilizing the toroidal lens or the cylindrical lens as a first lens, the vehicle light can prevent or suppress the generation of glare light due to the light distribution being above the horizontal line H-H and near the opposite vehicle road side.

In the vehicle light configured as described above, the LED light source can have an optical axis as a light emitting direction and can be disposed so as to direct the optical axis downward. The reflector can be disposed so as to extend from both sides of the LED light source to a position near the optical axis of the LED light source. The reflector can be configured to reflect light beams from the LED light source toward the first lens so as to form a predetermined light distribution pattern vertically converged and horizontally diffused.

In the vehicle light configured as described above, the reflector can be a revolved ellipsoidal reflector having a first focus and a second focus, the first focus can be disposed at or near the LED light source, and the second focus can be disposed between the first lens and the first reflector.

Accordingly, while utilizing the toroidal lens or the cylindrical lens as a first lens, the vehicle light can prevent or suppress the generation of glare light due to the light distribution above the horizontal line H-H and near the opposite vehicle road side.

According to further still another aspect of the presently disclosed subject matter, a vehicle light can include: an LED light source having an optical axis as a light emitting direction, disposed so as to direct the optical axis downward; a lens disposed forward of the LED light source, the lens having an optical axis and being shaped in an upper half lens shape above or almost above the optical axis; and a reflector configured to reflect light beams from the LED light source toward the lens so as to form a predetermined light distribution pattern.

In the vehicle light configured as described above, the lens can have a shape that does not include a lower-half portion below or almost below its optical axis, which is an area that is a typical cause of coloring of the area near the cut-off line. This configuration can prevent or suppress the generation of colored area (for example, blue) in a light distribution pattern near its cut-off line caused by the direct light from an LED light source or reflected light therefrom that enters a lower-half portion of a lens below or almost below its optical axis from the diagonally upper side. In addition to this, the vertical dimension of the vehicle light can be thinned by the cut lower half portion.

In the vehicle light configured as described above, the reflector can be disposed below the optical axis of the lens so as to reflect light beams from the LED light source toward the lens diagonally upward so as to form a desired light distribution pattern.

The reflector can reflect the light beams from the LED light source to cause the light beams to enter the lens not from a diagonally upper side but from a diagonally lower side. Accordingly, this configuration can prevent or suppress the generation of colored area (for example, blue) in a light distribution pattern near its cut-off line caused by the direct light from an LED light source or reflected light therefrom that enters a lower-half portion of a lens below or almost below its optical axis from the diagonally upper side.

In the vehicle light configured as described above, the reflector can be disposed so as to extend from both sides of the LED light source to a position near the optical axis of the LED light source. The reflector can be configured to reflect light beams from the LED light source toward the lens so as to form a light distribution pattern vertically converged and horizontally diffused.

In the vehicle light configured as described above, the reflector can be a revolved ellipsoidal reflector having a first focus and a second focus, the first focus can be disposed at or near the LED light source, and the second focus can be disposed between the lens and the reflector.

Accordingly, this configuration can prevent or suppress the generation of colored area (for example, blue) in a light distribution pattern near its cut-off line caused by direct light from an LED light source or reflected light therefrom that enters a lower-half portion of a lens below or almost below its optical axis from the diagonally upper side.

BRIEF DESCRIPTION OF DRAWINGS

These and other characteristics, features, and advantages of the presently disclosed subject matter will become clear from the following description with reference to the accompanying drawings, wherein.

DESCRIPTION OF EXEMPLARY EMBODIMENTS

A description will now be made below to vehicle lights made in accordance with principles of the presently disclosed subject matter with reference to the accompanying drawings in accordance with exemplary embodiments. In the present specification, the directions with regard to the "up," "down," "right," "left," "front," and "rear" and the like may be based on the case where the vehicle light is installed in a vehicle body. Namely, the directions may be considered to match to the vertical direction (up-to-down direction), the lateral direction (right-to-left or vehicle width direction), and the front-to-rear direction of the vehicle body.

The vehicle light 100 according to the present exemplary embodiment can be applied to a vehicle headlamp, a vehicle fog lamp or the like for use in a vehicle such as an automobile or the like. FIGS. 3 to 7 show the vehicle light 100. The vehicle light 100 of the present exemplary embodiment can include an LED light source 10, first to fifth reflectors 21 to 25, first to fifth lenses 31 to 35, and the like. Hereinbelow, a description will be given of respective constituents, but the presently disclosed subject matter is not limited to the illustrated respective constituents.

[LED Light Source 10]

Figure 8:
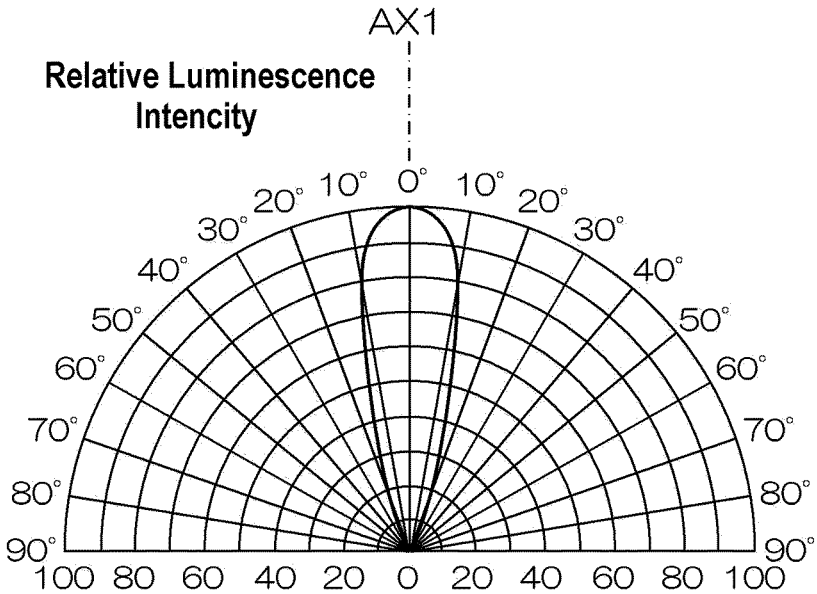
FIG. 8 is a schematic view illustrating the light intensity of light beams emitted from the LED light source which the vehicle light can utilize.

The LED light source 10 can be a surface light source with a rectangular shape with the long side to short side ratio of 4:1. For example, the LED light source 10 can include a light source package with one or more light emission chips (for example, blue) installed therein and a wavelength material layer including a phosphor material excited by the emission wavelength of the light emission chips for light emission (Lambertian emission, see FIG. 8) (for example, emitting yellow light). The energized LED light source 10 may generate a certain amount of heat, and accordingly, a radiator 50 is disposed above the LED light source 10, thereby effectively emitting heat. The radiator 50 can be formed of an aluminum heat sink or heat pipe, or the like.

Figure 6:
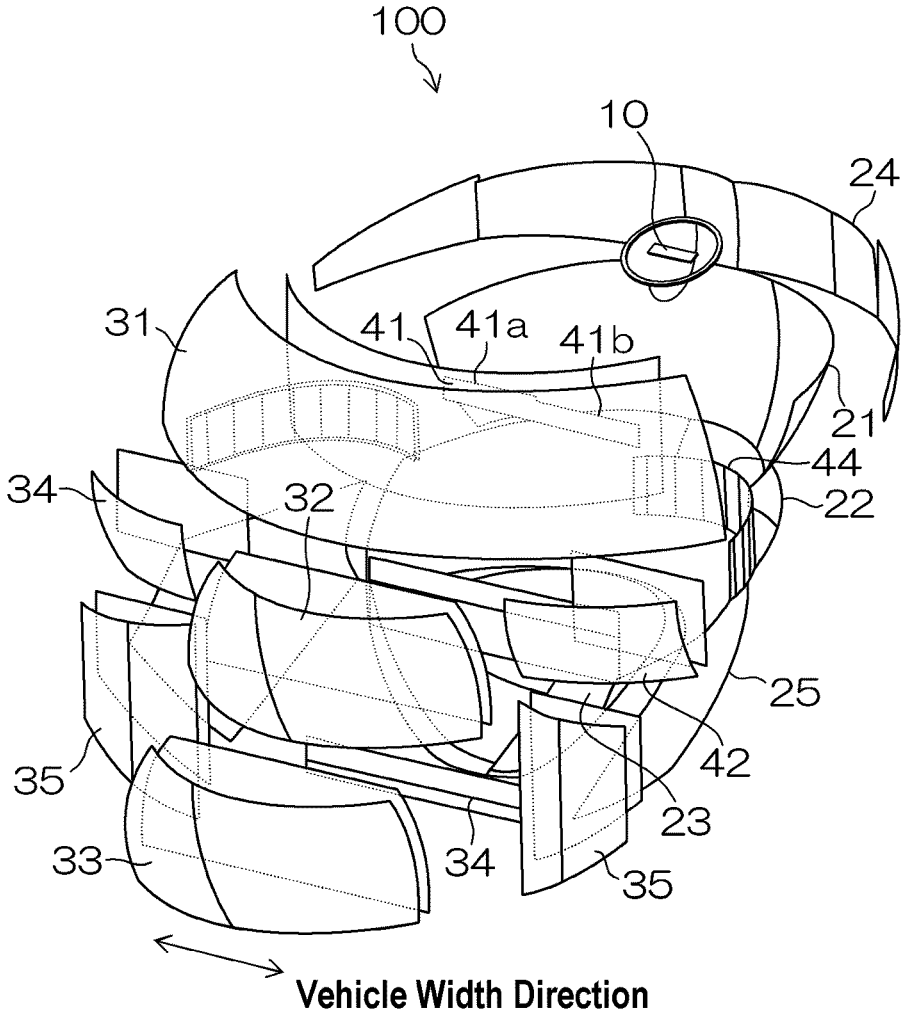
FIG. 6 is a schematic view illustrating the arrangement of respective lenses, respective reflectors, respective light shielding shutters, and the like constituting the vehicle light of FIG. 3.
Figure 7:
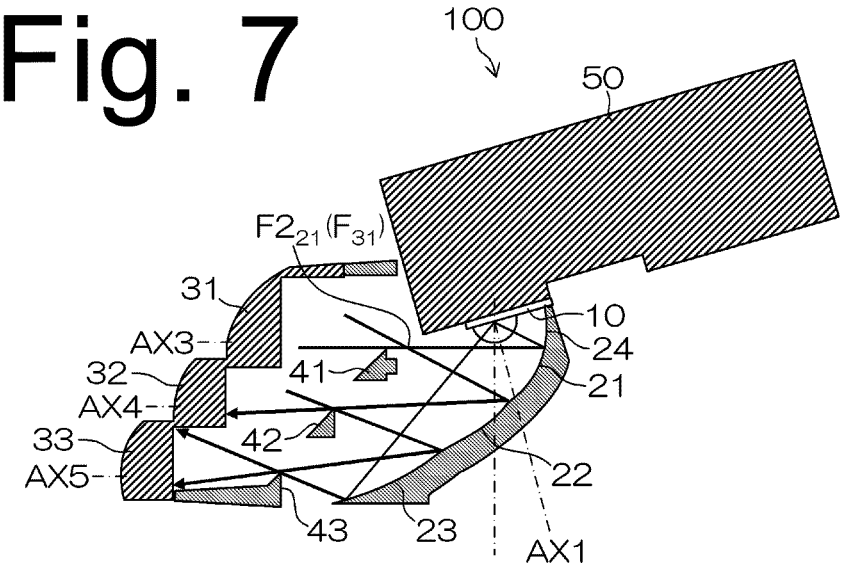
FIG. 7 is a cross sectional view of the vehicle light of FIG. 3 taken along line A-A of FIG. 4.

As shown in FIGS. 6 and 7, the LED light source 10 can be disposed so that the long side of the LED light source 10 is matched to the lateral direction (the vehicle width direction). Furthermore, the LED light source 10 can be disposed so that its light emitting direction (substantially equal to the optical axis AX1) is directed downward or its light emitting surface is directed downward and the optical axis AX1 is inclined rearward with respect to the vertical direction (for example, inclined by 30 degrees). However, the presently disclosed subject matter is not limited to the inclined optical axis. The LED light source 10 can be disposed so that the optical axis AX1 is directed in the vertical direction.

[Wide-Area Optical System]

Figure 9:
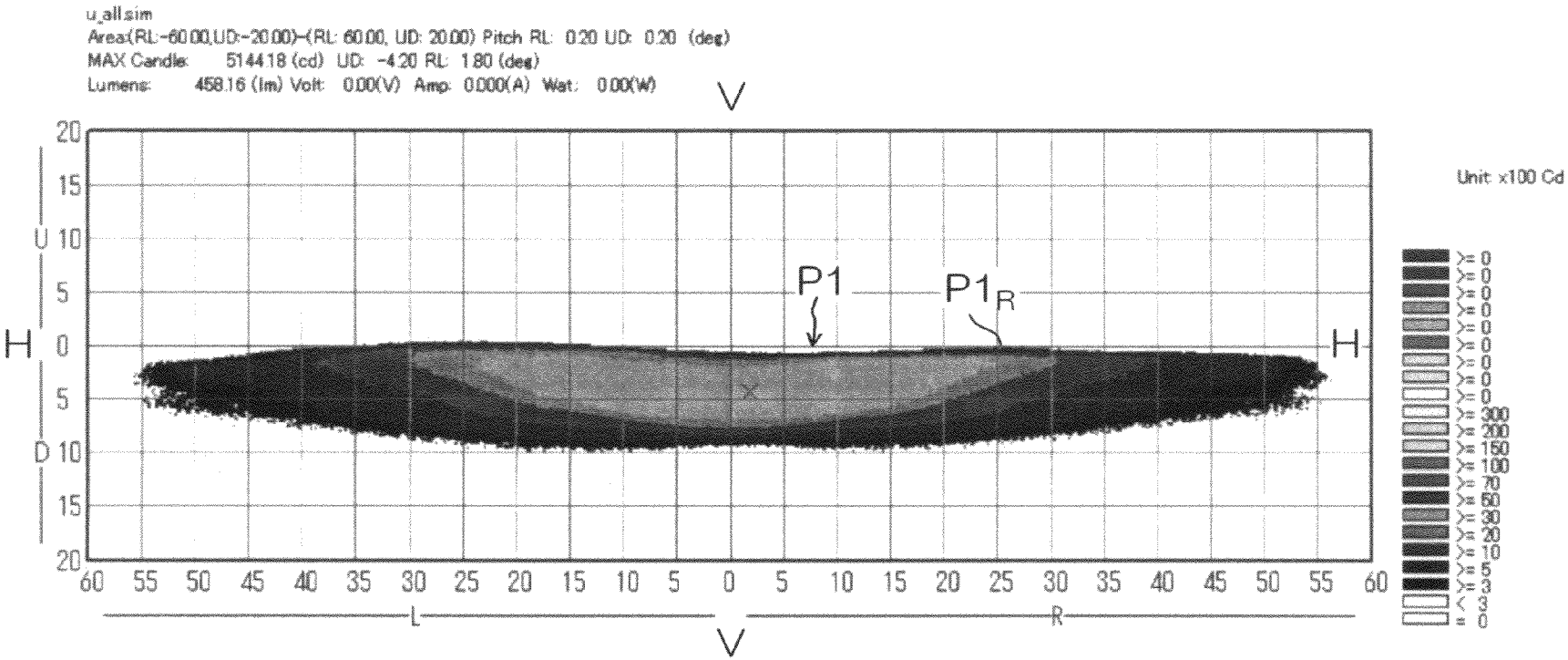
FIG. 9 is a diagram illustrating an exemplary wide-area light distribution pattern P1 formed by a wide-area optical system the vehicle light can utilize.

The first lens 31, the first reflector 21, and the first light shielding shutter 41 used in the vehicle light 100 can constitute a wide-area optical system for forming a wide-area light distribution pattern P1 (see FIG. 9) that is horizontally diffused.

[First Lens 31]

As shown in FIGS. 3 to 7, the first lens 31 can be disposed forward of the LED light source 10 so as to converge and image the entering light beams at a designed area.

The first lens 31 in the present exemplary embodiment can be shaped by horizontally cutting a toroidal lens of FIG. 10 below or almost below its optical axis (see FIGS. 3 to 7). In this case, the toroidal lens can be formed by, for example, horizontally extending an aspherical lens cross section 31*a* having a focus $F_{31}$ near the LED light source in an arc shape. Accordingly, the first lens 31 of the present exemplary embodiment can be an upper-half lens portion of the toroidal lens by cutting a lower-half lens portion. Its dimension including the rising wall side can be, for example, approx. 17 mm in height, approx. 50 mm in width, approx. 20 mm in focal distance, and approx. 10 mm in thickness.

The present exemplary embodiment can employ the partial toroidal lens as the first lens 31 in order to reduce the lateral size of the lens. However, the present exemplary embodiment may employ a partial cylindrical lens of which cylindrical axis extends in the horizontal direction, i.e., of which focus horizontally extends on the LED light source side.

Figure 10:
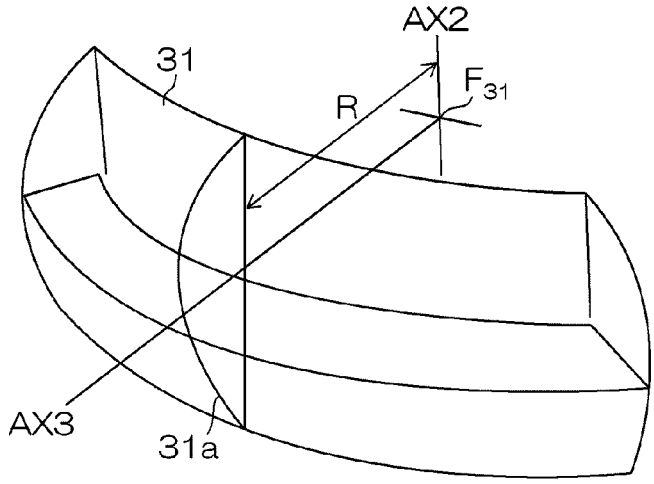
Fig. 10 Conventional Art
FIG. 10 is a perspective view of a conventional general toroidal lens without cutting its lower half portion.

Specifically, the basic toroidal lens for use as the first lens 31 can be obtained by rotating the aspherical lens cross section 31*a* around a vertical axis (rotation axis AX2) that passes the focus $F_{31}$ of the lens 31*a* as shown in FIG. 10. In this case, the toroidal lens may have a single focus $F_{31}$. Another exemplary toroidal lens may be obtained by rotating the aspherical lens cross section 31*a* around a vertical axis that does not pass the focus $F_{31}$ of the lens 31*a*. In this case, the toroidal lens may have a single focus $F_{31}$. Still another exemplary toroidal lens may be obtained by horizontally extending the aspherical lens cross section 31*a* in an arc shape. In this case, the toroidal lens may have a series of focuses $F_{31}$ in a corresponding arc shape.

Figure 11:
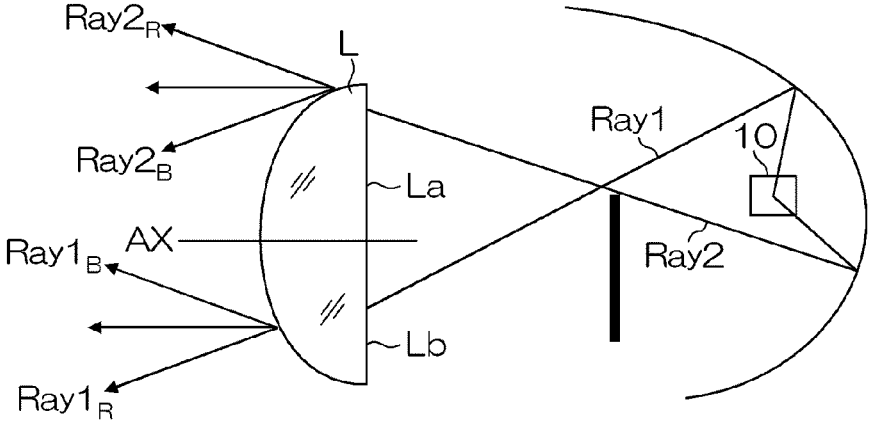
Fig. 11 Conventional Art
FIG. 11 is a schematic cross sectional view illustrating the conventional problem when light beams emitted form an LED light source enter the lower half portion of a lens from a diagonally upper side in a conventional vehicle light to cause coloring of an area near a cut-off line.
Figure 12:
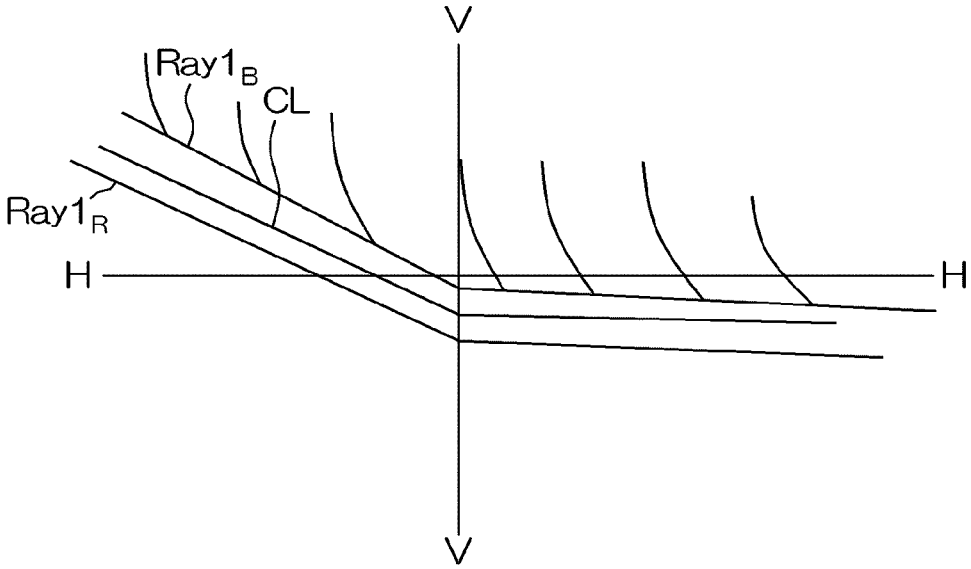
Fig. 12 Conventional Art
FIG. 12 is a schematic diagram showing the illuminated state near the cut-off line by the vehicle light of FIG. 11.
Figure 13:
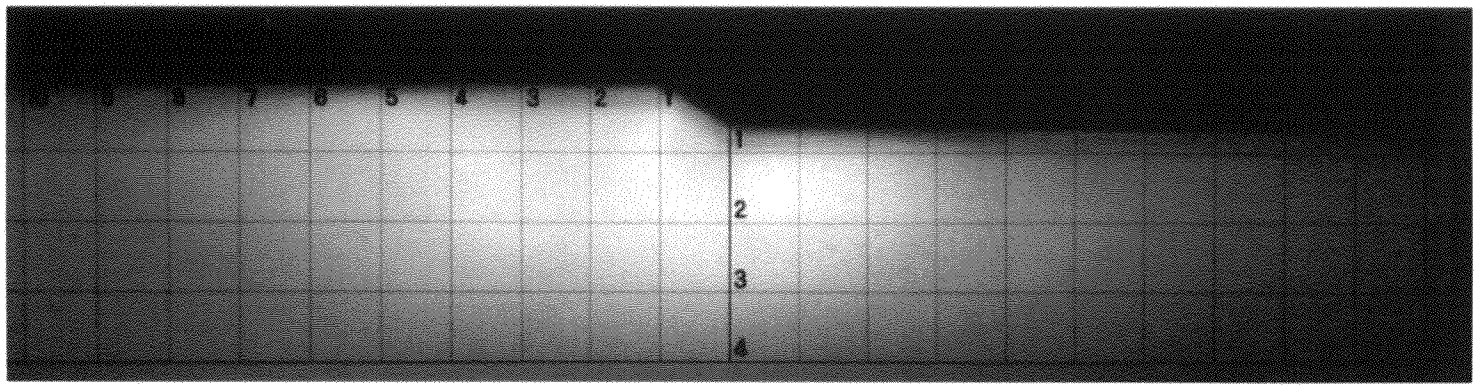
Fig. 13 Conventional Art
FIG. 13 is a diagram illustrating an exemplary light distribution pattern including its cut-off line formed by the lens of FIG. 10.
Figure 14:
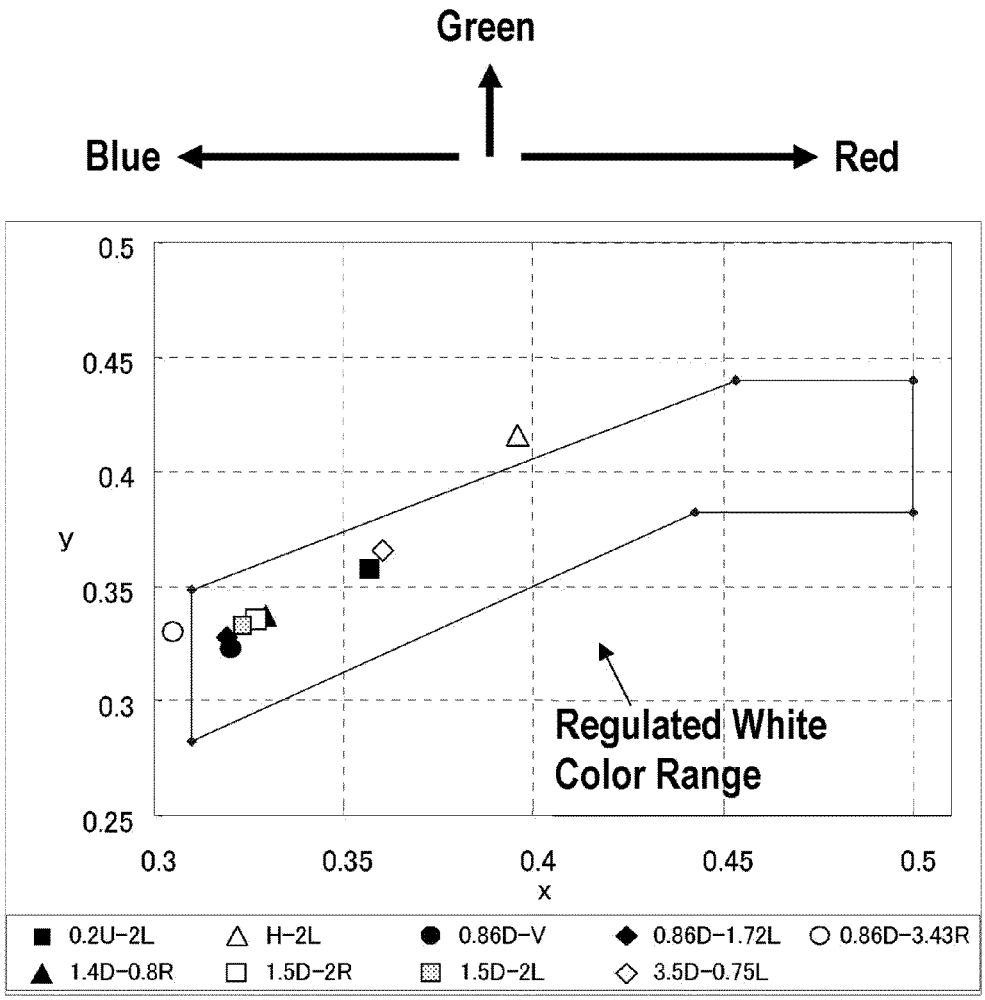
Fig. 14 Conventional Art
FIG. 14 is a diagram illustrating a regulated white color range with respect to the areas around the cut-off line formed by the lens of FIG. 10.
Figure 17:
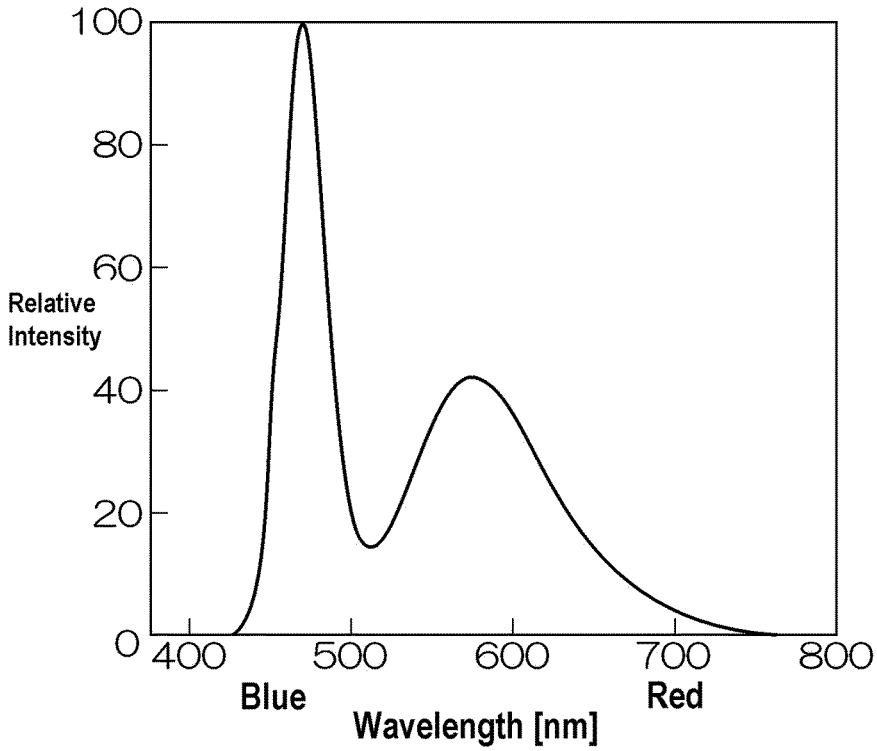
FIG. 17 is a diagram of an emission spectrum of an exemplary LED light source which a vehicle light of the presently disclosed subject matter can utilize.

Hereinafter, a description will be given of a case where a conventional toroidal lens is used as it is (not cut) with reference to FIG. 11. As shown, suppose that the light beam Ray1 from the LED light source 10 enters the lower-half lens portion $L_b$ of the converging lens L (which is a toroidal lens as a whole and from which the first lens 31, the second lens 32, the third lens 33, and the like may be formed by cutting) from the diagonally upper side. In this case, the light beam Ray1 may be diffused and its blue component Ray$\mathbf{1}_B$ (having longer wavelengths) may be refracted and projected in a diagonally upward direction by the action of the lower-half lens portion $L_b$. This configuration can distribute the light beam Ray$\mathbf{1}_B$ near the cut-off line CL of the light distribution pattern as shown in FIGS. 12 and 13, meaning that the area is colored blue. This colored area may impair the light distribution pattern in terms of white color specification in accordance with a certain regulation as shown in FIG. 14 (the mark triangle is positioned outside the regulated white-color range). In particular, as shown in FIG. 17, the LED light source 10 can have a greater light intensity at blue region than that at red region, meaning that the LED light source 10 can remarkably affect the coloring of blue in the light distribution pattern.

The present inventor has intensively studied to prevent the coloring near the cut-off line CL and has found that the conventional problem can be resolved by cutting the lower-half lens portion $L_b$ of the toroidal lens (see FIGS. 10 and 11) to complete the presently disclosed subject matter.

Based on the above finding, the present exemplary embodiment can employ the partial toroidal lens as the first lens 31 with a shape where the basic toroidal lens is horizontally cut below or almost below the optical axis AX3 of the basic aspherical lens cross section 31*a* (see FIGS. 3 to 7 and 10).

Figure 15:
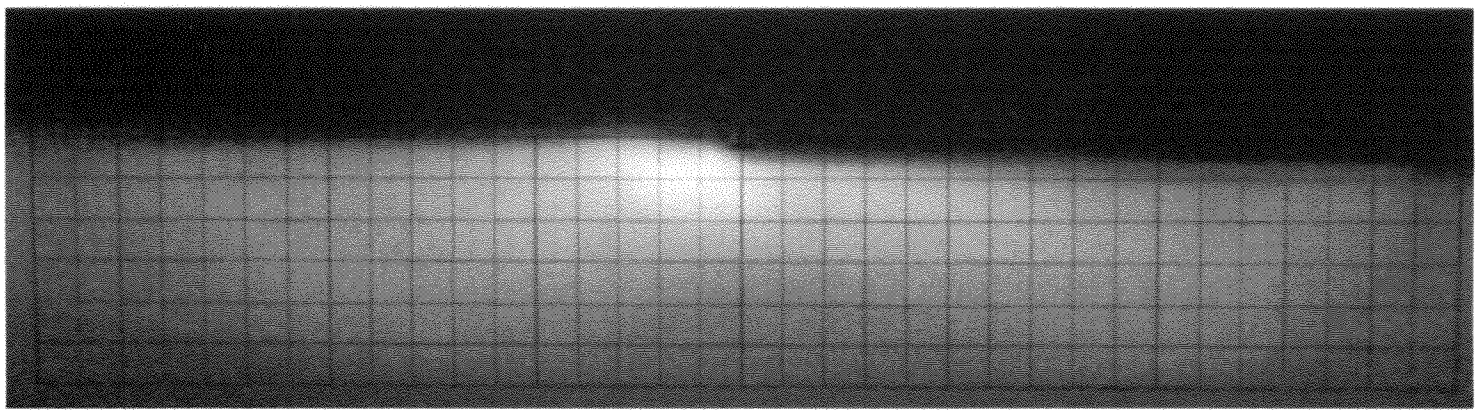
FIG. 15 is a diagram illustrating an exemplary light distribution pattern including its cut-off line formed by the lens of the exemplary light of FIG. 3.
Figure 16:
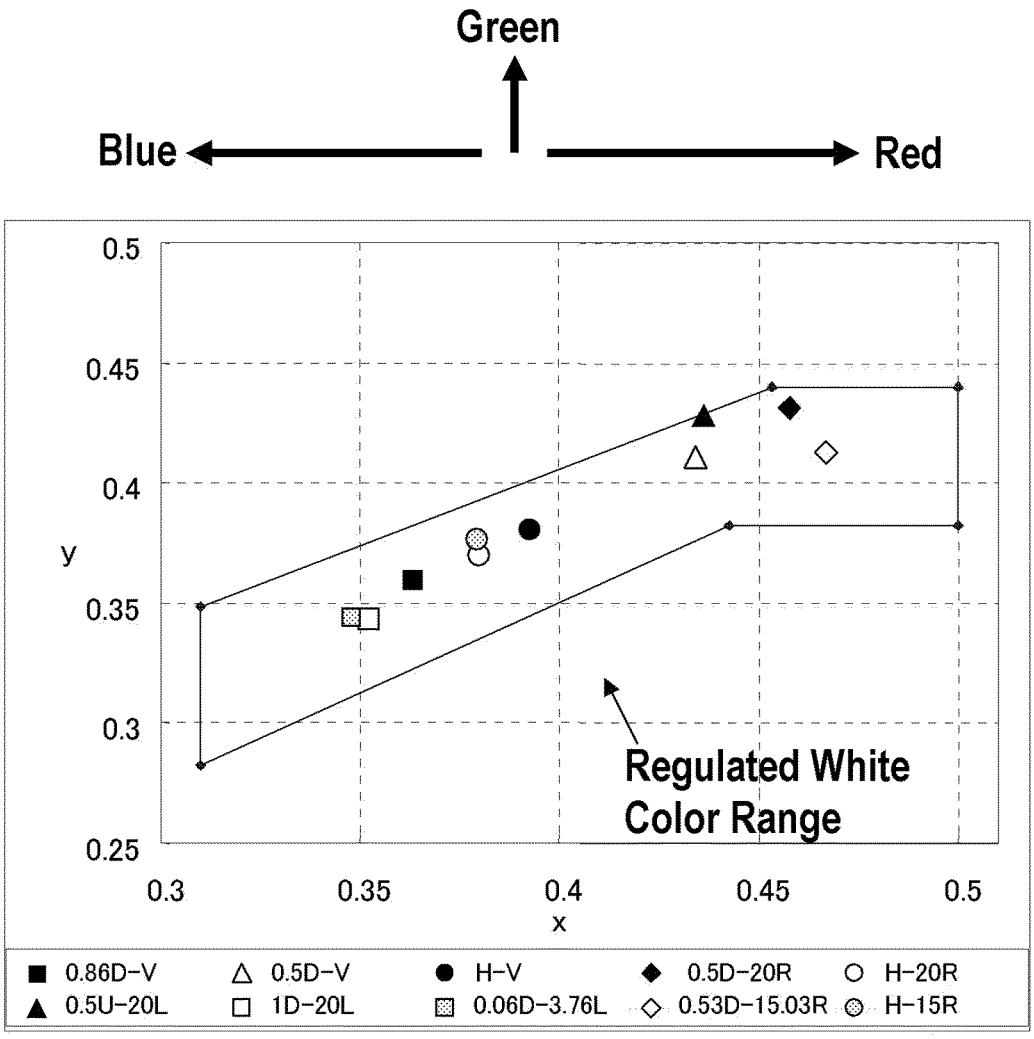
FIG. 16 is a diagram illustrating a regulated white color range with respect to the areas around the cut-off line formed by the lens of FIG. 3.

The present inventor has confirmed the following facts with respect to the respective lenses. Namely, the basic toroidal lens can form the light distribution pattern with the area near the cut-off line colored blue when visually observing the light distribution pattern of FIG. 13 while the first lens 31 utilizing the partial toroidal lens (the lower-half lens portion) of the present exemplary embodiment can form a light distribution pattern with the area near the cut-off line without being colored when visually observing the light distribution pattern of FIG. 15. Furthermore, the inventor has confirmed the fact by the chromaticity diagram that the basic toroidal lens can form the light distribution pattern with light beams outside the regulated white color range in terms of white color specification as shown in FIG. 14 while the first lens 31 can form the light distribution pattern with the light beams within the regulated white color range in terms of white color specification as shown in FIG. 16.

The first lens 31 can be formed by, for example, injection molding a material transparent in the visible range. Examples of the material includes, but are not limited to, transparent or semi-transparent resin materials such as an acrylic resin and a polycarbonate resin, a glass material and the like.

Figure 5:
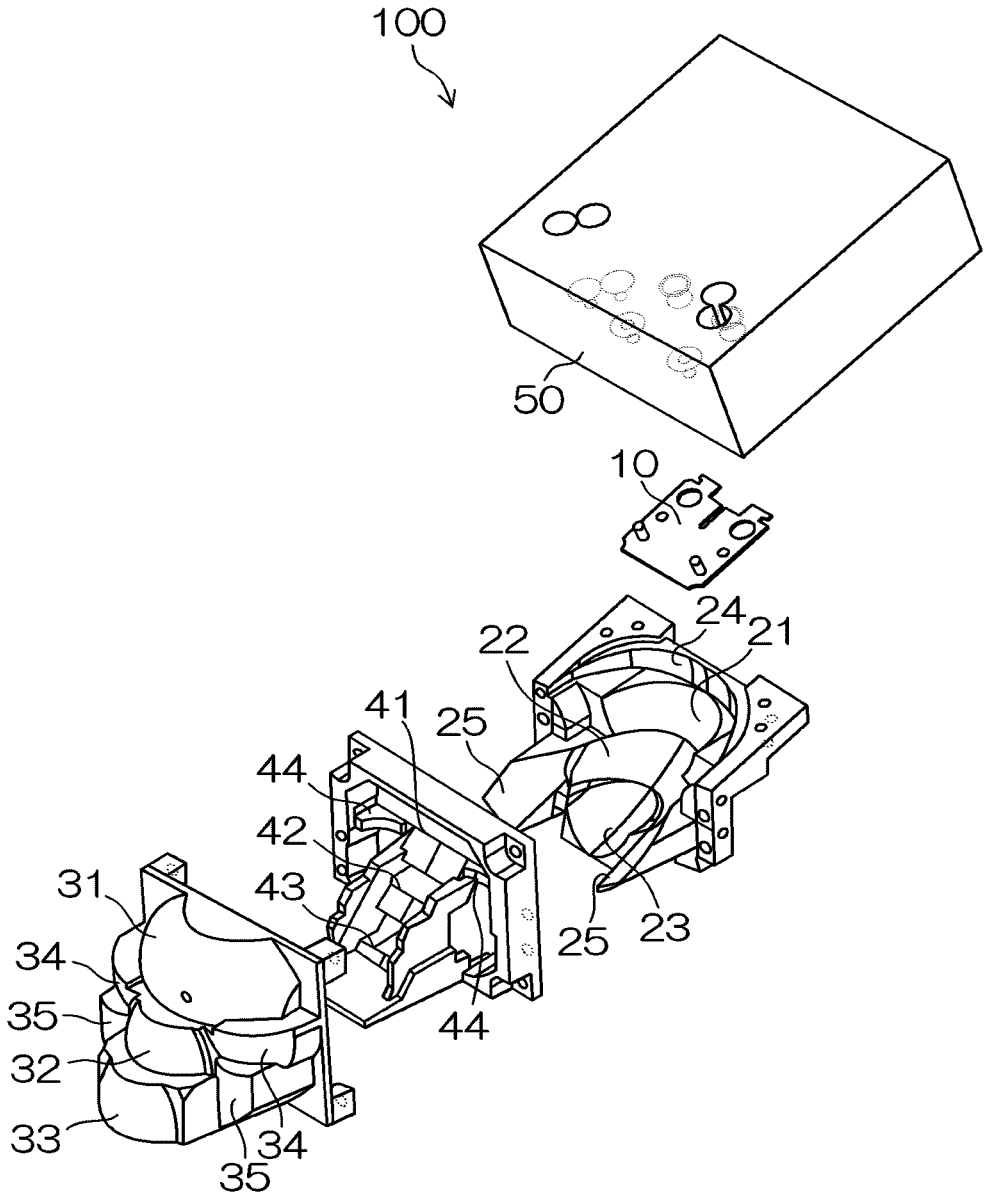
FIG. 5 is an exploded perspective view of the vehicle light of FIG. 3.

The first lens 31 can be integrally formed with the second lens 32, the third lens 33 and the like (to be described later) as shown in FIG. 5. Alternatively, they can be separately formed as independent components.

The first lens 31 can be formed from a material that has the same expansion coefficient as that of the first light shielding shutter 41. This configuration can prevent or suppress the deviation of the cut-off line of the wide-area light distribution pattern P1 with the temperature variation.

[First Reflector 21]

As shown in FIGS. 5 to 7, the first reflector 21 can be disposed rearward of the LED light source 10 and below the horizontal level of the optical axis AX3 of the first lens 31 so as to extend from both sides of the LED light source 10 to a position near the optical axis AX1 of the LED light source 10 (namely, below the LED light source 10). The first reflector 21 can be configured to utilize a laterally long light source image from the LED light source 10 near the optical axis AX1 with the light source image having relatively high light intensity (see FIG. 8) for appropriately forming the wide-area light distribution pattern. Furthermore, with the above configuration, the first reflector 21 can reflect light beams from the LED light source 10 toward the first lens 31 so that the light beams enter the first lens 31 mainly from the diagonally lower side (see FIG. 7). Accordingly, this configuration can prevent or suppress the generation of colored area in the light distribution pattern near its cut-off line CL caused by the light beams that enter from its diagonally upper side (see FIG. 11).

The first reflector 21 can reflect light beams from the LED light source 10 to slightly upward and forward direction so that the reflected light beams enter the first lens 31. The first lens 31 can vertically converge the received light beams (for example, by about 10 to 20 degrees) while horizontally diffuse them (for example, about 45 to 60 degrees). As a result, the wide-area light distribution pattern P1 (see FIG. 9) which is laterally wide can be formed.

The first reflector 21 can be formed of a revolved ellipsoidal reflector having a first focus and a second focus. For example, as shown in FIG. 7, the first focus can be disposed at or near the LED light source 10 (for example, near the center of the light emission surface of the LED light source 10). The second focus $F\mathbf{2}_{21}$ can be disposed between the first lens 31 and the first reflector 21 (for example, near or above the focus $F_{31}$ of the lens 31).

The first reflector 21 can be formed of a die-cast aluminum or a heat-resistant resin base with surface treatment such as aluminum deposition. The first reflector 21 can be integrally formed with the second reflector 22, the third reflector 23 and the like as shown in FIG. 5. Alternatively, they can be separately formed as independent components.

[First Light Shielding Shutter 41]

As shown in FIGS. 5 to 7, the first light shielding shutter 41 can be disposed between the first lens 31 and the first reflector 21, and can have an upper edge disposed at or near the focus $F_{31}$ of the first lens 31. This configuration can prevent the generation of glare light or the cut-off light distribution with less upward light beams for forming a low-beam light distribution or a fog lamp light distribution. It should be noted that when the first lens 31 is a partial cylindrical lens, such a light shielding shutter can be employed.

By the arrangement of the first light shielding shutter 41 and the physical relationship between the first lens 31 and the first reflector 21, the vehicle light 100 can form the wide-area light distribution pattern P1 so that the pattern P1 substantially does not include the upward light beams and is substantially positioned below the horizontal line H-H.

Figure 18:
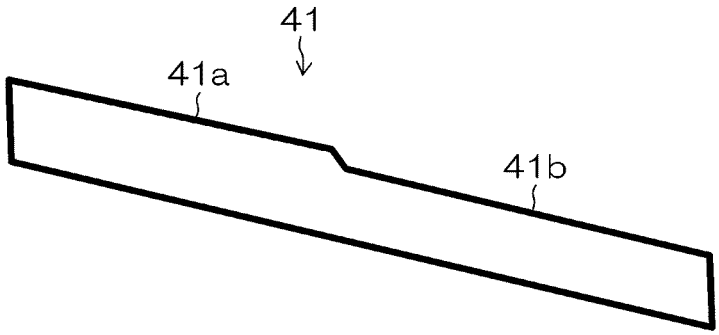
FIG. 18 is a perspective view of an exemplary first light shielding shutter the vehicle light of the presently disclosed subject matter can utilize.

It should be noted that in the present exemplary embodiment the first light shielding shutter 41 can be a plate light shielding member having a first upper edge portion 41*a* of the upper edge near the opposite vehicle road side is made higher than a second upper edge portion 41*b* near the travelling road side as shown in FIGS. 6 and 18 and the like. The first light shielding shutter 41 can be formed of a black opaque material. The first light shielding shutter 41 can be integrally formed with the second light shielding shutter 42, the third light shielding shutter 43 and the like as shown in FIG. 5. Alternatively, they can be separately formed as independent components.

If the first light shielding shutter 41 is employed, the second focus $F2_{21}$ of the first reflector 21 can be disposed above the focus $F_{31}$ of the first lens 31. By this configuration, the amount of light beams that are reflected by the first reflector 21 and shielded by the first light shielding shutter 41 can be reduced, thereby being capable of forming a brighter wide-area light distribution pattern P1.

Figure 19:
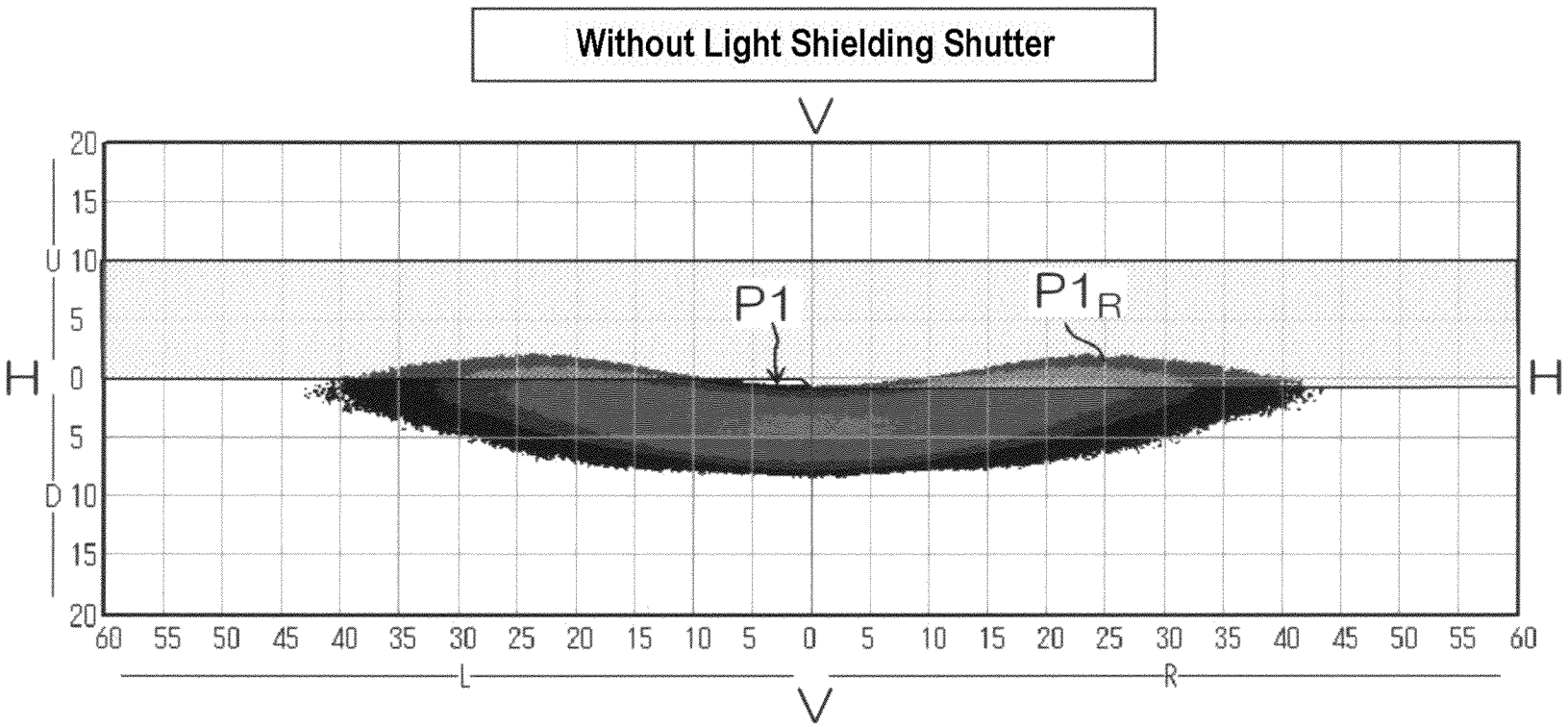
Fig. 19 Conventional Art
FIG. 19 is a diagram illustrating the conventional problem when a toroidal lens is used as the first lens and the first light shielding shutter has a plate with a straight upper edge.

A description will be given of the case where a plate shutter with a straight upper edge is used in a conventional vehicle light having a conventional toroidal lens or cylindrical lens. Such a toroidal lens may have a point focus or a series of focuses in an arc shape (or corresponding to the shape of the toroidal lens). Accordingly, in this case, as shown in FIG. 19, the light beams are distributed to an area $P1_R$ above the horizontal line H-H and on the opposite vehicle road side. The present inventor has found that this configuration may be a cause of generation of glare light.

The present inventor has intensively studied the above issues to prevent the light distribution at the area $P1_R$ above the horizontal line H-H and on the opposite vehicle road side, and has found the configuration where the first upper edge portion 41*a* of the upper edge of the first light shielding shutter 41 near the opposite vehicle road side is made higher than the second upper edge portion 41*b* near the travelling road side. The inventor has also found that the higher first upper edge portion 41*a* can shield the light beams that will be directed to the opposite vehicle road, thereby preventing the light distribution at the area $P1_R$ above the horizontal line H-H and on the opposite vehicle road side.

Based on this finding, the present exemplary embodiment can employ the first light shielding shutter 41 that is a plate light shielding member having the first upper edge portion 41*a* near the opposite vehicle road side is made higher than the second upper edge portion 41*b* near the travelling road side (see FIGS. 6 and 18).

Figure 20:
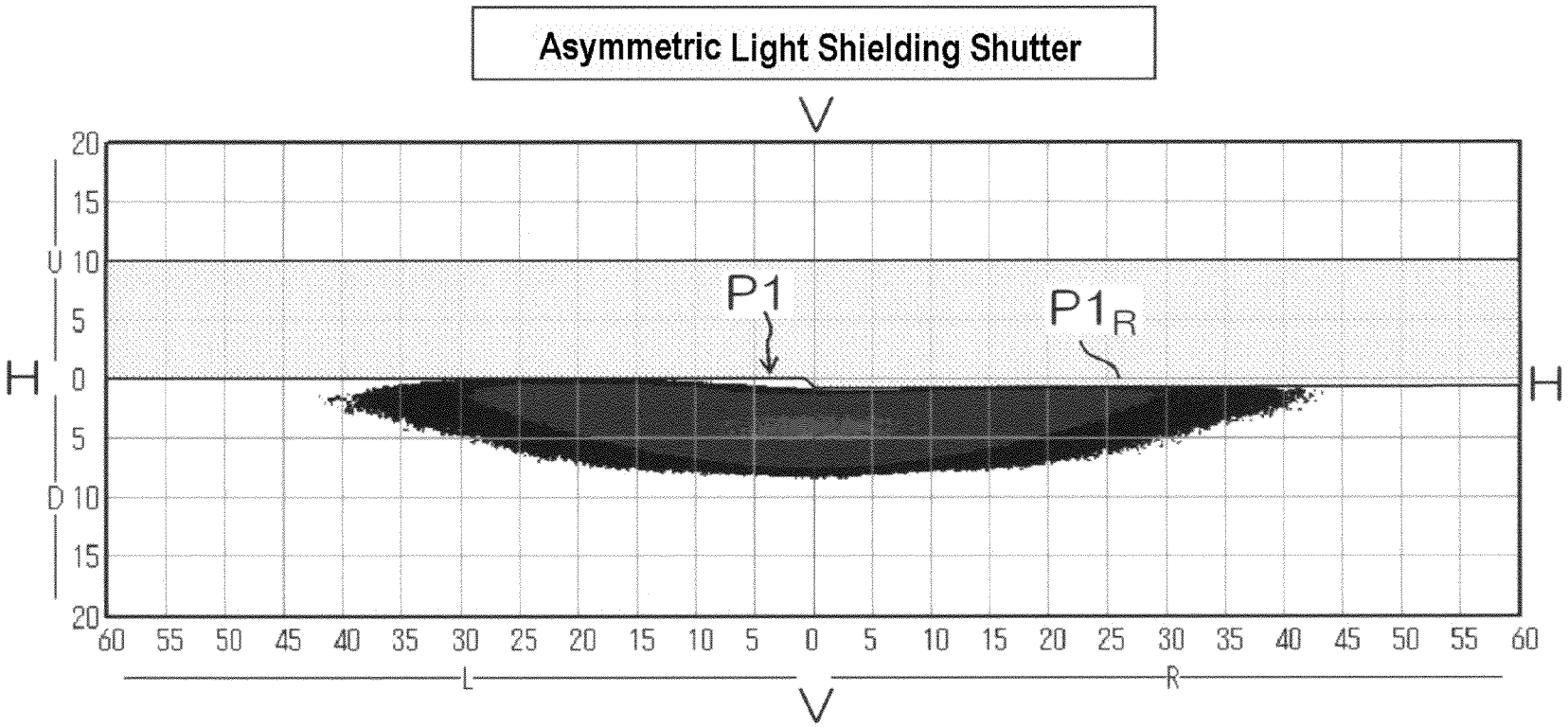
FIG. 20 is a diagram illustrating an exemplary wide-area light distribution pattern P1 formed by a wide-area optical system for a vehicle light of the presently disclosed subject matter.

The present inventor has confirmed by visually observing the wide-area light distribution pattern P1 (see FIGS. 9 and 20) that the vehicle light 100 with the wide-area optical system utilizing the above first light shielding shutter 41 does not distribute a significant portion of light beams at the area $P1_R$ above the horizontal line H-H and on the opposite vehicle road side, at least when compared to the conventional vehicle light.

[Wide-Area Light Distribution Pattern P1 Formed by the Wide-Area Optical System]

As described above, the wide-area optical system can be composed of the first lens 31, the first reflector 21, and the first light shielding shutter 41. Herein, the LED light source 10 can provide a laterally elongate light source image on or near its optical axis AX1 with relatively high light intensity, which is suitable for forming a wide-area light distribution pattern. If the wide-area optical system is utilized, the light beams from the LED light source 10 can be reflected by the first reflector 21 to be converged to the second focus $F_{21}$, and then enter the first lens 31. The first lens 31 can vertically converge the received light beams (for example, by about 10 to 20 degrees) while horizontally diffusing them (for example, about 45 to 60 degrees). As a result, a wide-area light distribution pattern P1 (see FIG. 9) that is laterally wide can be formed.

It should be noted that the degree of the vertical spread of light can be adjusted by, for example, the focal length of the basic aspherical lens cross section 31*a*, the physical relationship of the second focus F221 of the first reflector 21 and the like. Further, the degree of the horizontal spread of light can be adjusted by, for example, the incident angle to the first reflector 21, the radius R of the arc along which the basic aspherical lens cross section 31*a* extends, and the like.

[Middle-Area Optical System]

Figure 21:
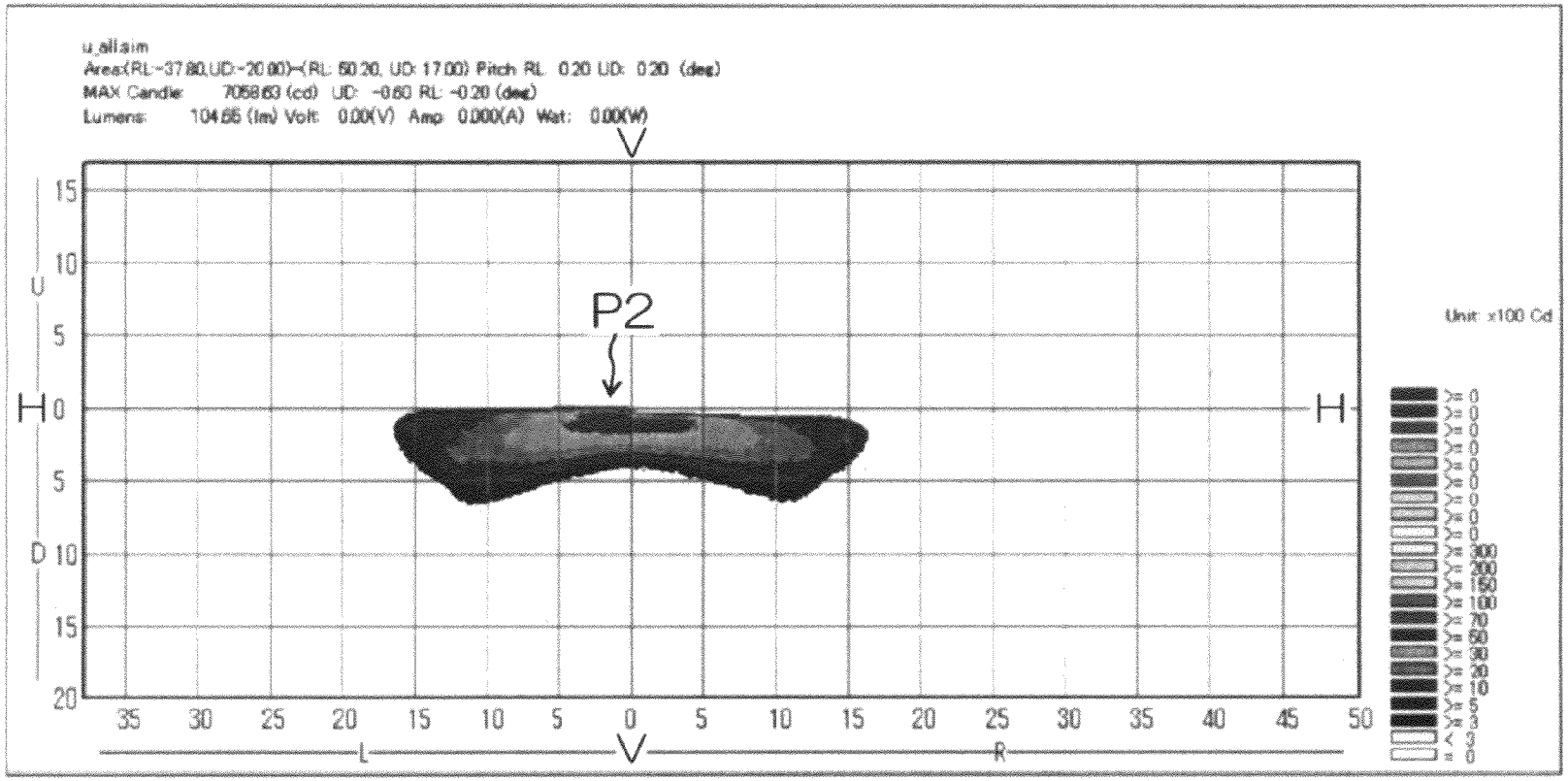
FIG. 21 is a diagram illustrating an exemplary middle-area light distribution pattern P2 formed by a middle-area optical system for a vehicle light of the presently disclosed subject matter.

The second lens 32, the second reflector 22, and the second light shielding shutter 42 used in the vehicle light 100 can constitute a middle-area optical system for forming a middle-area light distribution pattern P2 (see FIG. 21) that is highly converged.

[Second Lens 32]

As shown in FIGS. 3 to 7, the second lens 32 can be disposed below and forward of the first lens 31 (in the forward direction of the vehicle body).

The second lens 32 in the present exemplary embodiment can be shaped by horizontally cutting an aspherical lens below or almost below its optical axis AX4 as shown in FIGS. 3 to 7. Its dimension can be, for example, approx. 11 mm in height, approx. 27 mm in width, approx. 20 mm in focal distance, and approx. 10 mm in thickness. The second lens 32 can be composed of an upper-half lens portion of the aspherical lens as in the second lens 31, thereby preventing or suppressing the generation of colored area in the light distribution pattern near its cut-off line CL. The second lens 32 can be formed of the same material by the same method as those of the first lens 31.

[Second Reflector 22]

As shown in FIGS. 5 to 7, the second reflector 22 can be disposed below and forward of the first reflector 21 (in the forward direction of the vehicle body). The second reflector 22 can prevent the light beams from the LED light source 10 from being shielded by the first reflector 21 while being capable of utilizing the light beams that cannot be utilized by the first reflector 21. The second reflector 22 can be configured to utilize a light source image (as observed from an oblique direction) the apparent size of which is smaller than that used by the first reflector 21 for appropriately forming the middle-area light distribution pattern. Furthermore, with the above configuration, the second reflector 22 can reflect light beams from the LED light source 10 toward the second lens 32 so that the light beams enter the second lens 32 mainly from the diagonally lower side (see FIG. 7). Accordingly, this configuration can prevent or suppress the generation of colored area in the light distribution pattern near its cut-off line CL caused by the light beams that enter from its diagonally upper side (see FIG. 11).

The second reflector 22 can reflect light beams from the LED light source 10 to a direction slightly upward and forward so that the reflected light beams enter the second lens 32. The second lens 32 can vertically converge the received light beams (for example, by about 5 to 10 degrees) while horizontally diffuse them (for example, about 10 to 20 degrees). As a result, the appropriate middle-area light distribution pattern P2 (see FIG. 21) can be formed.

The second reflector 22 can be formed of a revolved ellipsoidal reflector or ellipsoidal free curved reflector having a first focus and a second focus. For example, as shown in FIG. 7, the first focus can be disposed at or near the LED light source 10 (for example, near the center of the light emission surface of the LED light source 10). The second focus $F2_{22}$ can be disposed between the second lens 32 and the second reflector 22 (for example, near or above the focus $F_{32}$ of the second lens 32).

The second reflector 22 can be formed of a die-cast aluminum or a heat-resistant resin base with surface treatment such as aluminum deposition. The second reflector 22 can be integrally formed with the first reflector 21, the third reflector 23 and the like as shown in FIG. 5. Alternatively, they can be separately formed as independent components.

[Second Light Shielding Shutter 42]

As shown in FIGS. 5 to 7, the second light shielding shutter 42 can be disposed between the second lens 32 and the second reflector 22, and can have an upper edge disposed at or near the focus $F_{32}$ of the second lens 32. This configuration can prevent the generation of glare light or can form an appropriate cut-off light distribution with less upward light beams for forming a low-beam light distribution or a fog lamp light distribution.

The second light shielding shutter 42 may be a plate light shielding member as shown in FIGS. 5 to 7. When taking the aberration of the second lens 32 into consideration, the second light shielding shutter 42 may be an arc-shaped light shielding member. The second light shielding shutter 42 can be formed of a black opaque material, for example. If the second light shielding shutter 42 is employed, the second focus $F2_{22}$ of the second reflector 22 can be disposed above the focus $F_{32}$ of the second lens 32. By this configuration, the amount of light beams that are reflected by the second reflector 22 and shielded by the second light shielding shutter 42 can be reduced, thereby being capable of forming a brighter middle-area light distribution pattern P2.

[Middle-Area Light Distribution Pattern P2 Formed by the Middle-Area Optical System]

As described above, the middle-area optical system can be composed of the second lens 32, the second reflector 22, and the second light shielding shutter 42. If the middle-area optical system is utilized, the light beams from the LED light source 10 can be reflected by the second reflector 22, and then enter the second lens 32. In particular, when the middle-area optical system is used, the light source image observed from an oblique direction can enter the second lens 32. The second lens 32 can vertically converge the received light beams (for example, by about 5 to 10 degrees) while horizontally diffuse them (for example, about 10 to 20 degrees). As a result, the highly converged middle-area light distribution pattern P2 (see FIG. 21) can be formed.

[Spot Optical System]

Figure 22:
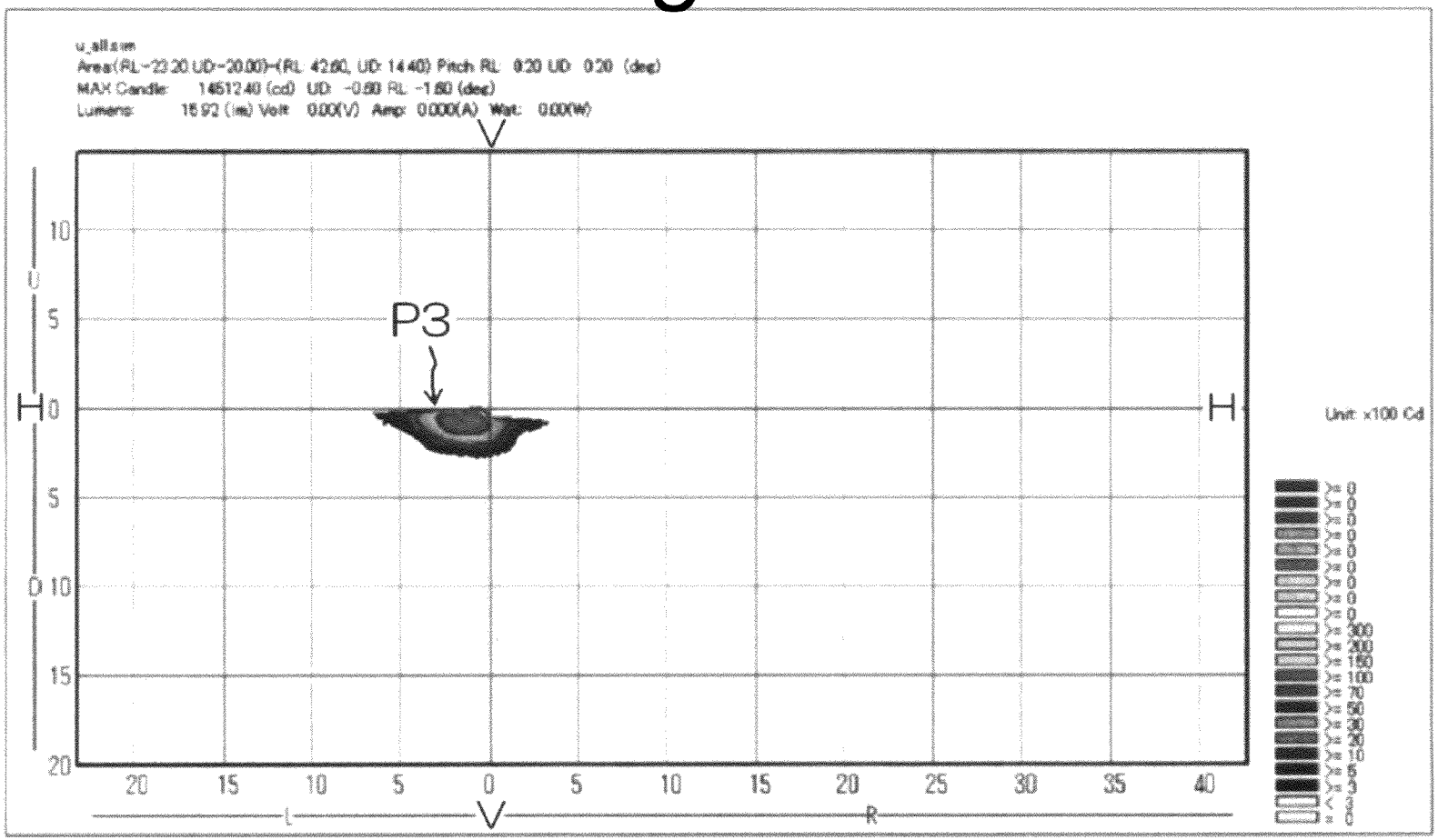
FIG. 22 is a diagram illustrating an exemplary spot light distribution pattern P3 formed by a spot optical system for a vehicle light of the presently disclosed subject matter.

The third lens 33, the third reflector 23, and the third light shielding shutter 43 used in the vehicle light 100 can constitute a spot-area optical system for forming a spot light distribution pattern P3 (see FIG. 22) that is converged more than that by the middle-area optical system.

[Third Lens 33]

As shown in FIGS. 3 to 7, the third lens 33 can be disposed below and forward of the second lens 32 (in the forward direction of the vehicle body).

The third lens 33 in the present exemplary embodiment can be shaped by horizontally cutting an aspherical lens below or almost below its optical axis AX5 as shown in FIGS. 3 to 7. Its dimension including its rising wall can be, for example, approx. 14 mm in height, approx. 27 mm in width, approx. 20 mm in focal distance, and approx. 10 mm in thickness. The third lens 33 can be composed of an upper-half lens portion of the aspherical lens shape, as in the second lens 32, thereby preventing or suppressing the generation of colored area in the light distribution pattern near its cut-off line CL. The third lens 33 can be formed of the same material by the same method as those of the first lens 31 and the second lens 32.

[Third Reflector 23]

As shown in FIGS. 5 to 7, the third reflector 23 can be disposed below and forward of the second reflector 22 (in the forward direction of the vehicle body). The third reflector 23 can prevent the light beams from the LED light source 10 from being shielded by the second reflector 22 while being capable of utilizing the light beams that cannot be utilized by the second reflector 22. The third reflector 23 can be configured to utilize a light source image (as observed from an oblique direction) of which an apparent size is smaller than that used by the second reflector 22 for appropriately forming the spot light distribution pattern.

The third reflector 23 can reflect light beams from the LED light source 10 to a slightly upward and forward direction so that the reflected light beams enter the third lens 33. The third lens 33 can vertically converge the received light beams (for example, by about 2 to 5 degrees) while horizontally diffusing them (for example, about 2 to 10 degrees). As a result, the appropriate spot light distribution pattern P3 (see FIG. 22) can be formed.

The third reflector 23 can be formed of a revolved ellipsoidal reflector or ellipsoidal free curved reflector having a first focus and a second focus. For example, as shown in FIG. 7, the first focus can be disposed at or near the LED light source 10 (for example, near the center of the light emission surface of the LED light source 10). The second focus $F2_{23}$ can be disposed between the third lens 33 and the third reflector 23 (for example, near or above the focus $F_{33}$ of the third lens 33).

The third reflector 23 can be formed of a die-cast aluminum or a heat-resistant resin base with surface treatment such as aluminum deposition. The third reflector 23 can be integrally formed with the first reflector 21, the second reflector 22 and the like as shown in FIG. 5. Alternatively, they can be separately formed as independent components.

[Third Light Shielding Shutter 43]

As shown in FIGS. 5 to 7, the third light shielding shutter 43 can be disposed between the third lens 33 and the third reflector 23, and can have an upper edge disposed at or near the focus $F_{33}$ of the third lens 33. This configuration can prevent the generation of glare light or can form an appropriate cut-off light distribution with less upward light beams for forming a low-beam light distribution or a fog lamp light distribution.

The third light shielding shutter 43 may be a plate light shielding member as shown in FIGS. 5 to 7. When taking the aberration of the third lens 33 into consideration, the third light shielding shutter 43 may be an arc-shaped light shielding member. The third light shielding shutter 43 can be formed of a black opaque material, for example. If the third light shielding shutter 43 is employed, the second focus $F2_{23}$ of the third reflector 23 can be disposed above the focus $F_{33}$ of the third lens 33. By this configuration, the amount of light beams that are reflected by the third reflector 23 and shielded by the third light shielding shutter 43 can be reduced, thereby capable of forming a brighter spot light distribution pattern P3.

[Spot Light Distribution Pattern P3 Formed by the Spot Optical System]

As described above, the spot optical system can be composed of the third lens 33, the third reflector 23, and the third light shielding shutter 43. If the spot optical system is utilized, the light beams from the LED light source 10 can be reflected by the third reflector 23, and then enter the third lens 33. In particular, when the spot optical system is used, the light source image observed from an oblique direction can enter the third lens 33. The third lens 33 can vertically converge the received light beams (for example, by about 2 to 5 degrees) while horizontally diffuse them (for example, about 2 to 10 degrees). As a result, the highly converged spot light distribution pattern P3 (see FIG. 22) which is converged more than the middle-area optical system can be formed.

[Additional Middle-Area Optical System]

Figure 23:
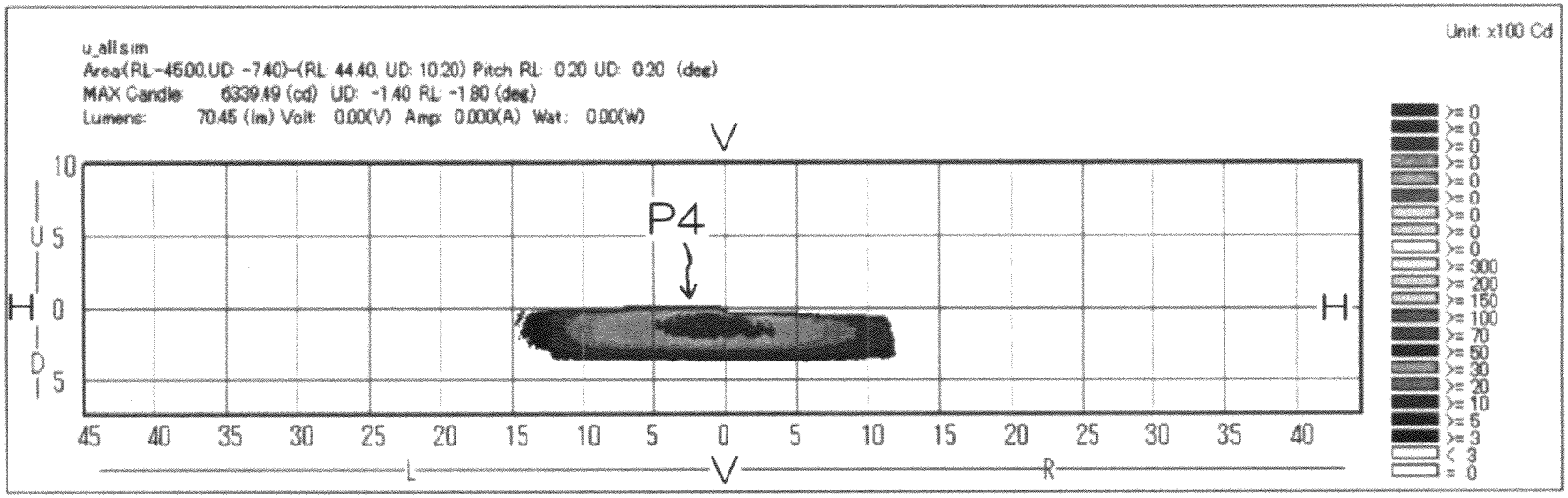
FIG. 23 is a diagram illustrating an exemplary additional middle-area light distribution pattern P4 formed by an additional middle-area optical system for a vehicle light of the presently disclosed subject matter.

The fourth lenses 34, the fourth reflector 24, and the fourth light shielding shutters 44 used in the vehicle light 100 can constitute an additional middle-area optical system for forming an additional middle-area light distribution pattern P4 (see FIG. 23) that is overlaid over the middle-area light distribution pattern P3.

[Fourth Lens 34]

As shown in FIGS. 3 to 7, the fourth lenses 34 can be disposed below and forward of the first lens 31 (in the forward direction of the vehicle body) and on either side of the second lens 32.

The fourth lens 34 in the present exemplary embodiment can be shaped by horizontally cutting an aspherical lens above or almost above its optical axis AX4 and at lower portion thereof as shown in FIGS. 3 to 7. Its dimension can be, for example, approx. 9 mm in height, approx. 15 mm in width, approx. 20 mm in focal distance, and approx. 10 mm in thickness. The fourth lens 34 can be composed of an aspherical lens cut at its lower portion, thereby preventing or suppressing the generation of colored area in the light distribution pattern near its cut-off line CL as in the case of the first lens 31 that is formed by cutting approximately its lower half portion. The fourth lens 34 can be formed of the same material by the same method as those of the lenses 31, 32 and 33.

Note that the fourth lens 34 can be formed of an aspheric lens with the upper-half lens portion being cut horizontally. In a conventional vehicle light, as shown in FIG. 11, when the light beam Ray1 from the LED light source 10 enters the lens portion $L_b$ from the diagonally upper side, the light beam Ray1 may be diffused and its blue component Ray$\mathbf{1}_B$ (having longer wavelengths) may be refracted and projected in a diagonally upward direction by the action of the lower-half lens portion $L_b$. Then, the configuration can distribute the light beam Ray$\mathbf{1}_B$ near the cut-off line CL of the light distribution pattern as shown in FIG. 12, meaning that the area is colored blue. In the present exemplary embodiment, the light beams entering the fourth lens 34 may be light beams emitted laterally from the LED light source 10 at a shallow angle and within a vertically narrow angle range. In addition, since the light beams are not refracted by the fourth lens 34 so much, the coloring near the cut-off line CL is not remarkable, if any.

[Fourth Reflector 24]

As shown in FIGS. 5 to 7, the fourth reflector 24 can be disposed rearward of the LED light source 10 and above the first reflector 21 and the horizontal level of the fourth lenses 34 so as to extend to both sides of the LED light source 10. The fourth reflector 24 can be configured to utilize a light source image (substantially laterally-long light source image) an apparent size of which is smaller than that used by the first reflector 21 for appropriately forming the additional middle-area light distribution pattern.

The fourth reflector 24 can reflect light beams from the LED light source 10 toward the fourth lenses 34. The fourth lenses 34 can vertically converge the received light beams (for example, by about 3 to 10 degrees) while horizontally diffusing them (for example, about 5 to 15 degrees). As a result, the appropriate additional middle-area light distribution pattern P4 (see FIG. 23) can be formed.

The fourth reflector 24 can be formed of a revolved ellipsoidal reflector or ellipsoidal free curved reflector having a first focus and a second focus. For example, the first focus can be disposed at or near the LED light source 10 (for example, near the center of the light emission surface of the LED light source 10). The second focus can be disposed so that the fourth lenses 34 can vertically converge the received light beams (for example, by about 3 to 10 degrees) while horizontally diffusing them (for example, about 5 to 15 degrees).

The fourth reflector 24 can be formed of a die-cast aluminum or a heat-resistant resin base with surface treatment such as aluminum deposition. The fourth reflector 24 can be integrally formed with the first reflector 21, the second reflector 22, the third reflector 23 and the like as shown in FIG. 5. Alternatively, they can be separately formed as independent components.

Furthermore, the fourth reflector 24 can be composed of a pair of reflectors disposed symmetry with respect to the second lens 22 or independent of each other. In order to improve the light incident efficiency with respect to the right side fourth lens and left side forth lens 34, the fourth reflector 24 can be composed of two to four (or more) reflecting surfaces.

[Fourth Light Shielding Shutter 44]

As shown in FIGS. 5 and 6, the fourth light shielding shutters 44 can be disposed between the fourth lenses 34 and the fourth reflector 24, and can each have an upper edge disposed at or near the focus of each fourth lens 34. This configuration can prevent the generation of glare light or can form an appropriate cut-off light distribution with less upward light beams for forming a low-beam light distribution or a fog lamp light distribution.

The fourth light shielding shutter 44 may be an arc-shaped (or plate) light shielding member as shown in FIGS. 5 and 6 while taking the aberration of the fourth lens 34 into consideration. The fourth light shielding shutter 44 can be formed of a black opaque material, for example. If the fourth light shielding shutters 44 are employed, the second focus of each of the fourth reflectors 24 can be disposed above the focus of the corresponding fourth lens 34. By this configuration, the amount of light beams that are reflected by the fourth reflector 24 and shielded by the fourth light shielding shutter 44 can be reduced, thereby capable of forming a brighter additional middle-area light distribution pattern P4.

[Additional Middle-Area Light Distribution Pattern P4 Formed by the Additional Middle-Area Optical System]

As described above, the additional middle-area optical system can be composed of the fourth lenses 34, the fourth reflector 24, and the fourth light shielding shutters 44. The fourth reflector 24 can reflect light beams from the LED light source 10 (substantially laterally-long light source image) toward the fourth lenses 34. The fourth lenses 34 can vertically converge the received light beams (for example, by about 3 to 10 degrees) while horizontally diffusing them (for example, about 5 to 15 degrees). As a result, the highly converged additional middle-area light distribution pattern P4 (see FIG. 23) can be formed.

[Overhead-Sign Optical System]

Figure 24:
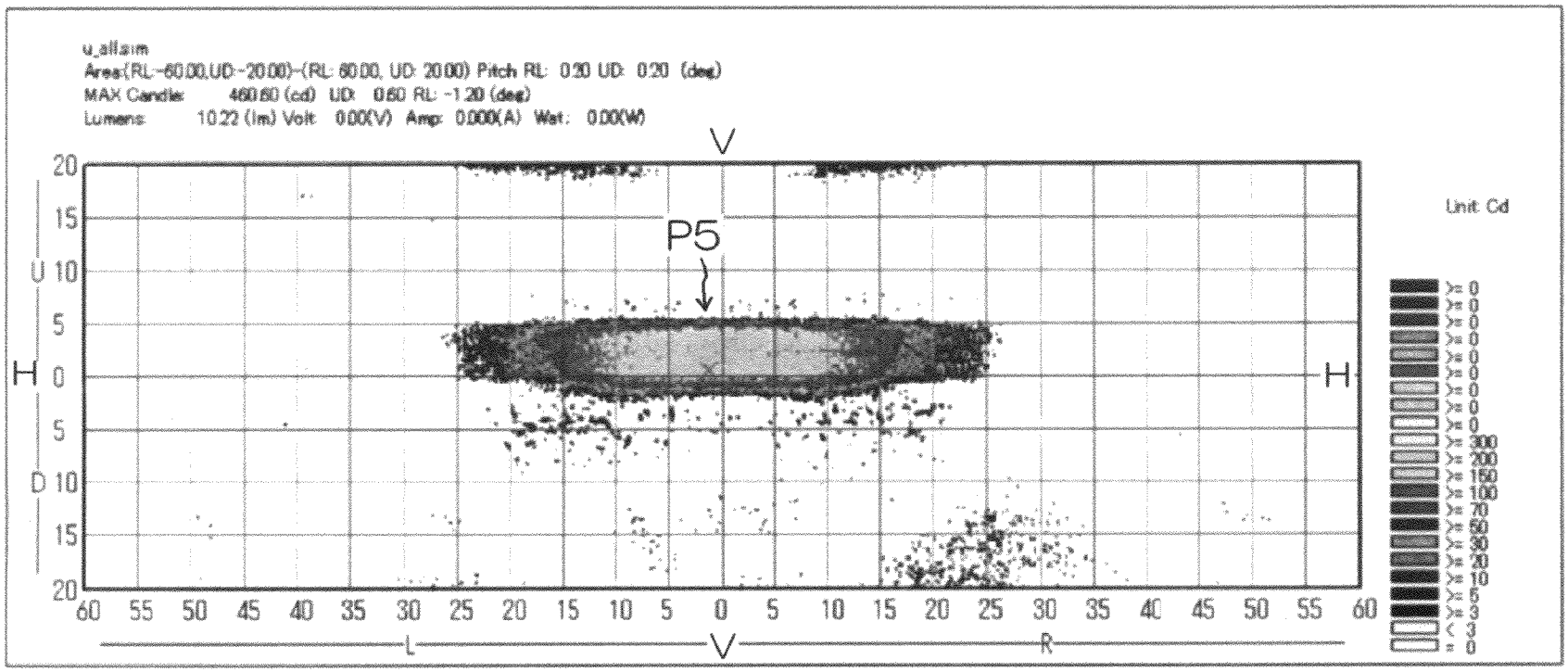
FIG. 24 is a diagram illustrating an exemplary overhead-sign visible light distribution pattern P5 formed by an overhead-sign optical system for use with a vehicle light of the presently disclosed subject matter.

The fifth lenses 35 and the fifth reflectors 25 used in the vehicle light 100 can constitute an overhead-sign optical system for forming an overhead-sign visible light distribution pattern P5 (see FIG. 24) that is overlaid over the middle-area light distribution pattern P3.

[Fifth Lens 35]

As shown in FIGS. 3 to 6, the fifth lenses 35 can be disposed on either side of the third lens 33 (and partially the second lens 32).

The fifth lens 35 in the present exemplary embodiment can be formed of a cylindrical lens having its vertical cylinder axis, such as a flute cut lens or the like, as shown in FIGS. 3 to 6. Its dimension can be, for example, approx. 9 mm in thickness. The fifth lens 34 can be formed of the same material by the same method as those of the lenses 31, 32, 33, and 34.

[Fifth Reflector 25]

As shown in FIGS. 5 and 6, the fifth reflectors 25 can be disposed on either side of the third reflector 23 (and partially the second reflector 23). The fifth reflectors 25 can reflect light beams from the LED light source 10 toward the corresponding fifth lenses 35. The fifth lenses 35 can horizontally diffuse the received light beams so as to form an overhead-sign visible light distribution pattern P5 (see FIG. 24).

The fifth reflector 25 can be formed of a revolved parabolic reflector (or parabolic free curved reflector) having a focus disposed at or near the LED light source 10 (for example, near the center of the light emission surface of the LED light source 10).

Note that the fifth reflector 25 can have its rotary axis appropriately inclined forward with respect to the horizontal level in order to distribute the light beams for forming the over-head sign visible light distribution pattern P5 above the horizontal line H-H, but not to generate glare light.

The fifth reflectors 25 can be formed of a die-cast aluminum or a heat-resistant resin base with surface treatment such as aluminum deposition. The fifth reflectors 25 can be integrally formed with the first to fourth reflectors 21 to 24 and the like as shown in FIG. 5. Alternatively, they can be separately formed as independent components.

[Overhead-Sign Visible Light Distribution Pattern P4 Formed by the Overhead-Sign Optical System]

As described above, the overhead-sign optical system can be composed of the fifth lenses 35 and the fifth reflectors 25. The fifth reflectors 25 can reflect light beams from the LED light source 10 (largely inclined light source image) toward the fifth lenses 35. The fifth lenses 35 can horizontally diffuse the received light beams. As a result, the overhead-sign visible light distribution pattern P5 (see FIG. 24) can be formed.

[Synthesized Light Distribution Pattern P]

Figure 25:
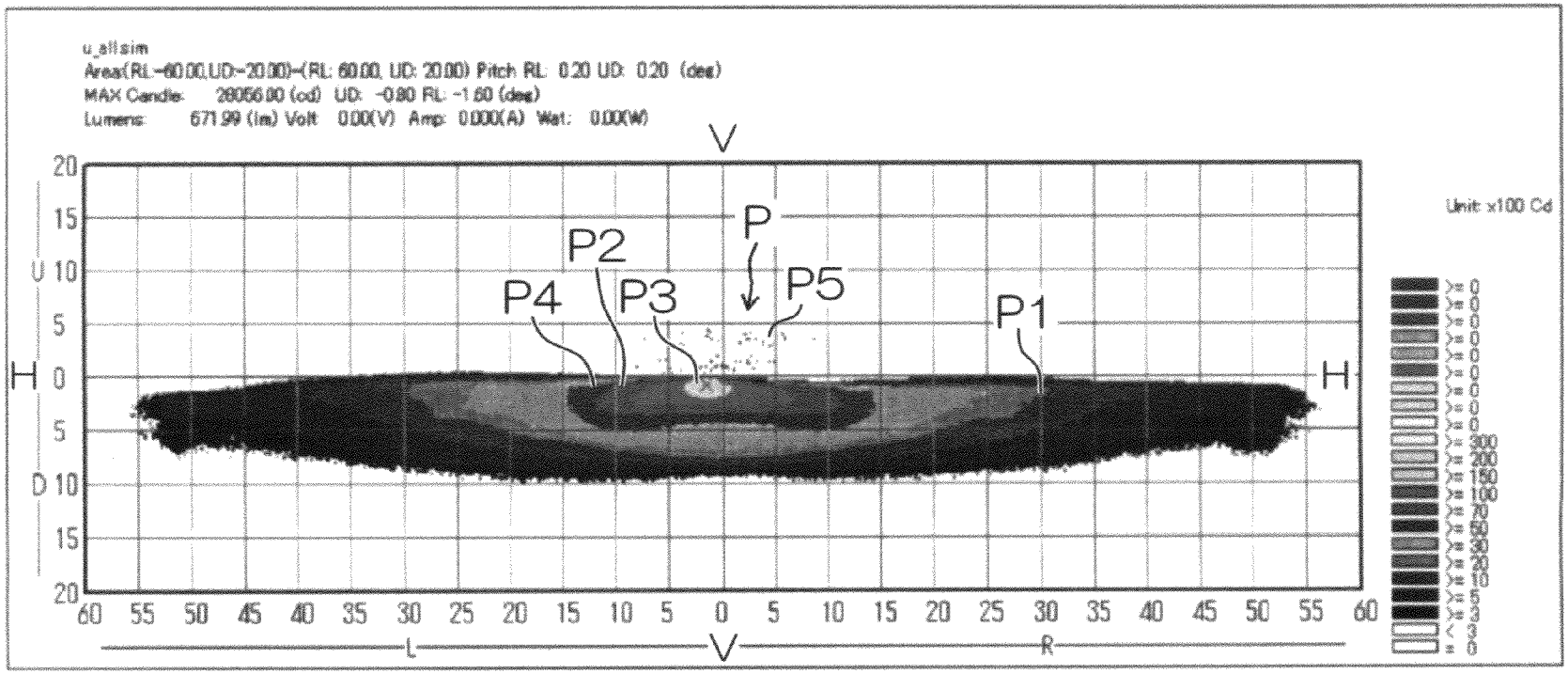
FIG. 25 is a diagram illustrating an exemplary synthesized light distribution pattern P optimized as a travelling light distribution pattern formed by a vehicle light of the presently disclosed subject matter.

The light distribution patterns P1 to P5 formed by the respective optical systems can be overlaid on each other as shown in FIG. 25, so that the synthesized light distribution pattern P can be formed while optimized as a travelling light distribution pattern. Specifically, referring to FIG. 25, the wide-area light distribution pattern P1, the middle-area light distribution patterns P2 and P4, and the spot light distribution pattern P3 formed by the respective optical systems can be combined and synthesized to form the optimal light distribution pattern.

Incidentally, if the respective lenses 31 to 34 and the respective light shielding shutters 41 to 44 are formed of various materials each having a different expansion coefficient, when a surrounding temperature rises (or lowers), the cut-off lines of the respective light distribution patterns P1 to P4 may be deviated one by one. Accordingly, the structures may be formed of the same material (for example, the same resin material) with the same expansion coefficient. In this case, they may be integrally molded or separately formed and then fixed to each other by laser welding or the like method, so that the integral body can be formed as shown in FIG. 5.

Figure 1:
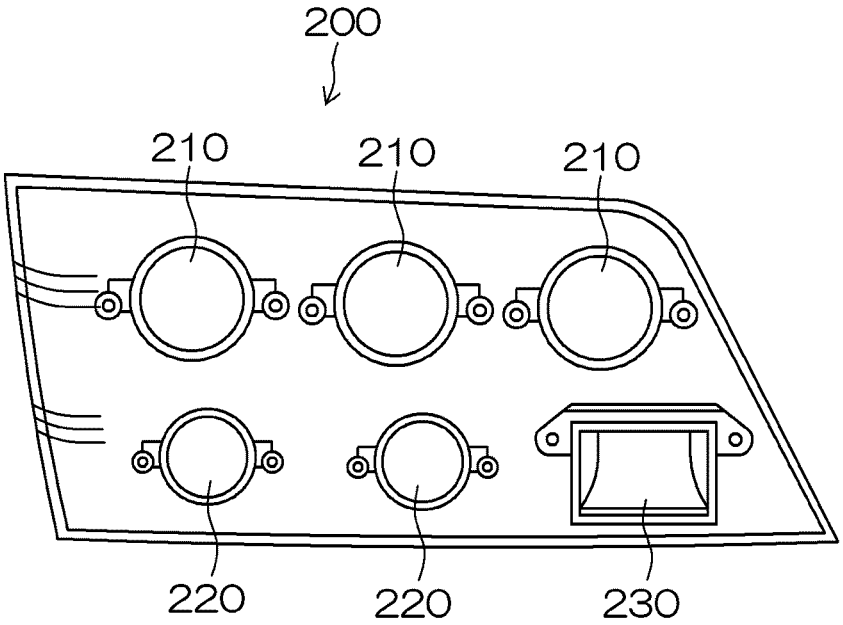
Fig. 1 Conventional Art
FIG. 1 is a front view showing an exemplary conventional vehicle light utilizing an LED light source.
Figure 2:
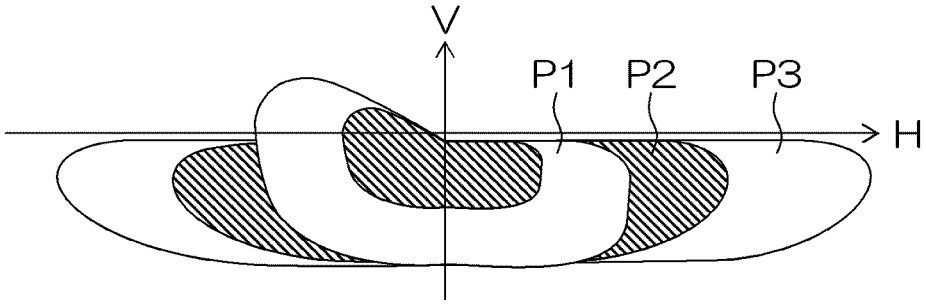
Fig. 2 Conventional Art
FIG. 2 is a diagram illustrating a synthesized light distribution pattern formed by the vehicle light of FIG. 1.
Figure 3:
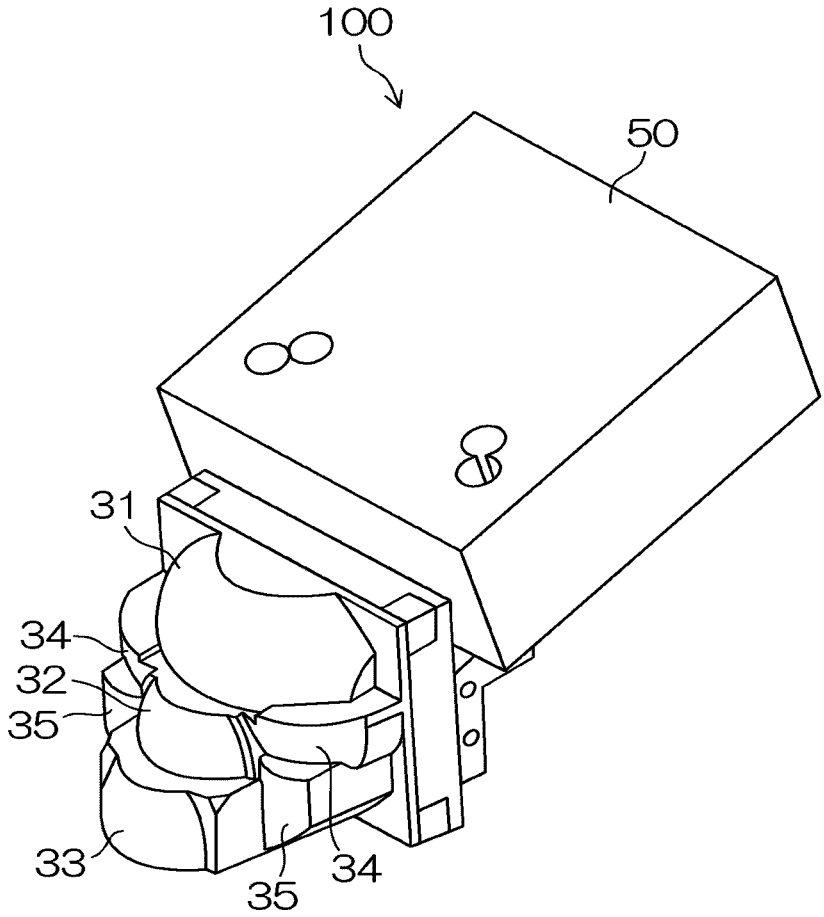
FIG. 3 is a perspective view of a vehicle light made in accordance with principles of the presently disclosed subject matter.
Figure 4:
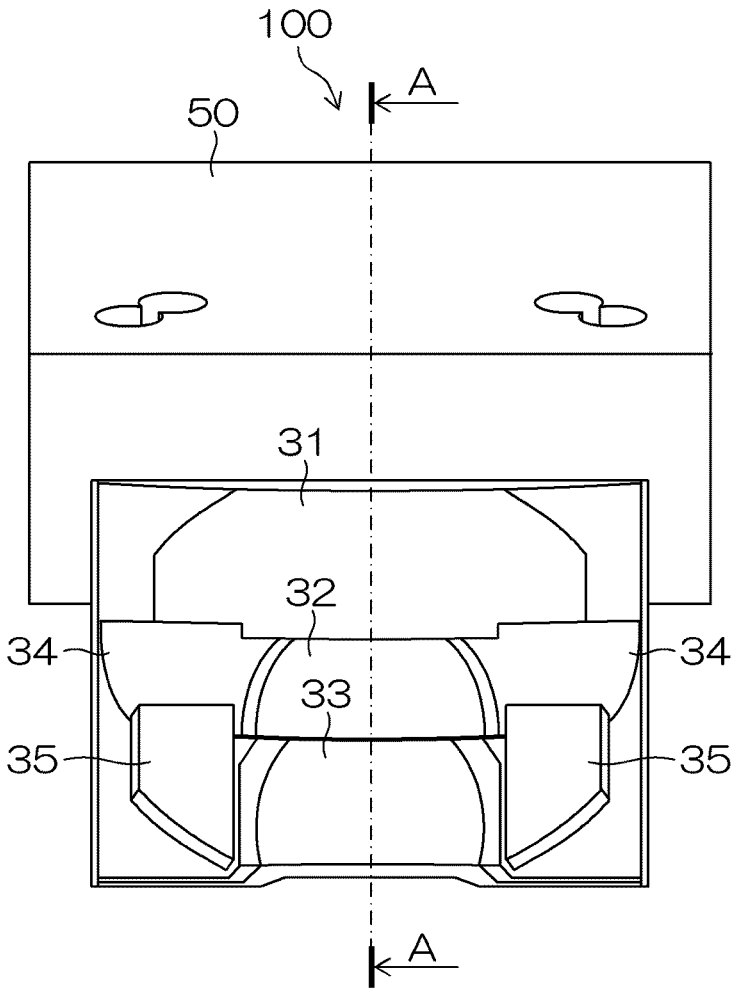
FIG. 4 is a front view of the vehicle light of FIG. 3.

As described, when forming a synthesized light distribution pattern including a wide-area light distribution pattern, a middle-area light distribution pattern, and a spot light distribution pattern, the conventional vehicle light 200 of FIG. 1 is typically provided with the light converging unit, the large diffusion unit and the middle diffusion unit each having at least one LED light source. On the contrary, the vehicle light 100 according to the above exemplary embodiment can be composed of various reflectors 21 to 23 and lenses 31 to 33 appropriately designed and arranged so as to form the optimized, synthesized light distribution pattern P (for example, for a low beam, a high beam or so) including the wide-area light distribution pattern P1, the middle-area light distribution pattern P2, and the spot light distribution pattern P3 and the like with the single LED light source 10. Accordingly, when compared with the conventional one, the vehicle light according to the presently disclosed subject matter can prevent cost increase in terms of design flexibility and part numbers.

Furthermore, the first lens (or partial toroidal lens) 31, the second lens 32, the third lens 33, the fourth lenses 34 and the like can be shaped by cutting the lower-half lens portions of the basic lenses below their optical axes (see FIGS. 3 to 7), which portions otherwise become a cause of coloring the area near the cut-off line CL. This configuration can prevent or suppress the generation of colored area (for example, blue) in the light distribution pattern near its cut-off line CL caused by the direct or reflected light from the LED light source 10 that enters from the diagonally upper side (see FIG. 11). In addition to this, the vertical dimension of the vehicle light can be thinned by the cut lower half portion.

Furthermore, in the vehicle light 100 of the present exemplary embodiment, the reflectors (in particular, the first reflector 21 and the second reflector 22) can be disposed below the respective optical axes of the corresponding lenses (the first lens 31 and the second lens 32, see FIG. 7). Then, the LED light source 10 can be disposed so that the light emitting direction is directed downward (the light emission surface faces downward). Accordingly, the reflectors 21 to 23, for example, can reflect the light beams forward and diagonally upward so that the respective lenses 31 to 33 can receive the reflected light from the diagonally lower side (see FIG. 7). Accordingly, this configuration can prevent or suppress the generation of colored area in the light distribution pattern near its cut-off line CL caused by the light from an LED light source that enters a lens from the diagonally upper side (see FIG. 11).

In the vehicle light 100 of the present exemplary embodiment, the first light shielding shutter 41 can have the first upper edge portion 41*a* and the second upper edge portion 41*b* of the upper edge with the first upper edge portion 41*a* being higher than the second upper edge portion 41*b*. This configuration can prevent upward light beams toward the opposite vehicle road by the action of the first upper edge portion 41*a*. Accordingly, while utilizing the toroidal lens or the cylindrical lens as the first lens 31, the vehicle light 100 can prevent or suppress the generation of glare light due to the light distribution at the area P1 above the horizontal line H-H and near the opposite vehicle road side.

Furthermore, the respective light shielding shutters 41 to 44 can form the cut-off lines of the respective light distribution patterns P1 to P4 clearly defined by their upper edges.

The vehicle light 100 of the present exemplary embodiment can utilize a small-sized aspherical lens with a short focal distance as the second lens 32 and the third lens 33 or the like. Even when utilizing such aspherical lenses, the combination of the multiple lenses 31 to 35 can prevent the lowering of the light intensity as a whole and the lowering of the degree of freedom for the light distribution while achieving the thinning of the vehicle light in the depth direction.

The vehicle light 100 of the present exemplary embodiment can be configured such that the respective lenses 31 to 33 are disposed in a stepwise manner. Consequently, the integrated lens portion as a whole can be formed in an inclined shape while the reflectors 21 to 23 can be formed also in an inclined shape as a whole (see FIG. 5). Accordingly, the vehicle light 100 can be utilized for a vehicle light unit corresponding to a headlamp having a slanted-forward design with an offset outer lens. Namely, the shape of the vehicle light 100 as a whole can be matched to a vehicle headlamp with a slanted-forward design that cannot be achieved by a conventional vehicle light. Furthermore, the dimension can be thinned accordingly.

The vehicle light 100 of the present exemplary embodiment can utilize the combination of multiple lenses 31 to 35 three-dimensionally. Accordingly, this configuration can provide a novel appearance that is remarkably different from that of a conventional round vehicle light. In addition, the combined lenses 31 to 35 can provide a high class appearance with beautiful crystalline appearance.

Incidentally, a projector type single lens for use with an LED light source may have a large thickness, and there is the problem in which such a thick lens may have shrink sink during its injection molding process with a resin material. To cope with this problem, a metal mold for injection molding is usually specially designed and/or a complicated process including highly accurate control for injection pressure, cooling, and the like is required. This raises the manufacturing cost therefor. In contrast to this, the respective lenses 31 to 35 of the vehicle light 100 of the present exemplary embodiment can be designed to have a small size with small thickness, meaning there is little or no problem during injection molding and leading to cost reduction.

The vehicle light 100 of the present exemplary embodiment can include the radiator 50 disposed above the LED light source 10 whereas a conventional one may have a radiator below an LED light source. When the LED light source 10 is energized, heat generated thereby may effectively be dissipated by the radiator 50 due to its arrangement.

Incidentally, when manufacturing a conventional vehicle light with a plurality of independent optical units including a light converging unit, a middle diffusion unit, a large diffusion unit, and the like, adjustment process (aiming process) such as adjusting the units for respective optical axes, adjusting respective cut-off lines, and the like may be required as well as requiring corresponding adjustment jigs. This may increase the manufacturing costs. In contrast to this, the vehicle light 100 of the present exemplary embodiment can be configured without assembling multiple optical units having been separately assembled. Accordingly, optical axes adjustment process and jigs are not required and processes therefor can be simplified or omitted.

Next, a description will be given of several modifications of the above exemplary embodiment.

The exemplary embodiment has dealt with the case where five optical systems including the wide-area, middle-area, spot, additional middle-area, and overhead-sign optical systems are employed, but the presently disclosed subject matter is not limited to this particular example. These optical systems may be combined with each other appropriately. For example, when a fog lamp is designed, the vehicle light 100 may be composed only of the wide-area and middle-area optical systems. When another type headlamp is designed, the vehicle light 100 may be composed only of the wide-area, middle-area and spot optical systems.

The present exemplary embodiment has dealt with the case where a single vehicle light 100 is used for a vehicle headlight, but the presently disclosed subject matter is not limited thereto. For example, if a single LED light source 10 cannot satisfy a certain specification in terms of light intensity, a plurality of vehicle lights 100 may be combined to constitute a vehicle headlight. Off course, another type vehicle light may be combined with the present vehicle light.

The radiator 50 in the present exemplary embodiment has a box shape as shown in the drawings, but the presently disclosed subject matter is not limited thereto. A radiator with different shape such as those surrounding the LED light source can be utilized.

In the above exemplary embodiment, the light shielding shutters 41 to 44 are formed of a black opaque material, but the presently disclosed subject matter is not limited thereto. For example, a colored light shielding shutter may be employed in terms of aesthetic purpose. In this case, the shutter can be formed by, for example, molding a colored material, by molding a transparent material and then coloring it, by molding an appropriate material and deposing aluminum thereon followed by coloring, or the like.

The present exemplary embodiment has dealt with the case where the light shielding shutters 41 to 44 are disposed appropriately, but the presently disclosed subject matter is not limited thereto. For example, the light shielding shutters 41 to 44 may be omitted partially or entirely according to required specifications (for a low beam, a high beam, a special purpose beam or the like).

The above configurations has dealt with the case where the optical axis of the LED light source is directed downward and the respective lenses, reflectors, and light shielding shutters are arranged with respect to the basic position of the LED light source. However, the presently disclosed subject matter can be composed of the up-side-down configuration, namely, the optical axis of the LED light source can be directed upward and the respective lenses, reflectors, and light shielding shutters can be arranged on the basis of the up-side-down LED light source position. In this case, the vehicle light can provide a unique shape with a slanted-upward design. Further, the unique arrangement of the lenses that can be observed from its front side can be utilized to enhance the aesthetic feature of a vehicle body.

It will be apparent to those skilled in the art that various modifications and variations can be made in the presently disclosed subject matter without departing from the spirit or scope of the presently disclosed subject matter. Thus, it is intended that the presently disclosed subject matter cover the modifications and variations of the presently disclosed subject matter provided they come within the scope of the appended claims and their equivalents. All related art references described above are hereby incorporated in their entirety by reference.

What is claimed is:

1. A vehicle light, comprising:

an LED light source having an optical axis defining a light emitting direction, the LED light source disposed such that the optical axis is inclined with respect to a vertical axis;

a first lens disposed forward of the LED light source;

a second lens disposed below or above, and forward of the first lens;

a first reflector disposed at a position opposite to the first lens, with the LED light source located between the first reflector and first lens such that the first reflector extends from both sides of the LED light source to a position adjacent the optical axis of the LED light source, the first reflector configured to reflect light beams from the LED light source toward the first lens so as to form a vertically converged and horizontally diffused wide light distribution pattern;

a second reflector disposed at a position below or above, and forward of the first reflector and opposite to the second lens, with the LED light source located between the second reflector and second lens, the second reflector configured to reflect light beams from the LED light source toward the second lens so as to form a vertically converged and horizontally diffused middle-area light distribution pattern.

2. The vehicle light according to claim 1, wherein:

the LED light source is disposed such that the optical axis is directed downward;

the second lens is disposed below and forward of the first lens; and the second reflector is disposed at a position below and forward of the first reflector.

3. The vehicle light according to claim 1, wherein:

the LED light source is disposed such that the optical axis is directed upward;

the second lens is disposed above and forward of the first lens; and the second reflector is disposed at a position above and forward of the first reflector.

4. The vehicle light according to claim 2, wherein the first reflector is a revolved ellipsoidal reflector having a first focus and a second focus, the first focus located substantially at the LED light source, and the second focus located between the first lens and the first reflector, wherein the second reflector is a revolved ellipsoidal reflector having a first focus and a second focus, the first focus located substantially at the LED light source, and the second focus located between the second lens and the second reflector.

5. The vehicle light according to claim 4, further comprising:

at least one of a first light shielding shutter and a second light shielding shutter, wherein the first light shielding shutter has an upper edge and is disposed between the first lens and the first reflector so that the upper edge is disposed substantially at a focus of the first lens, and wherein the second light shielding shutter has an upper edge and is disposed between the second lens and the second reflector so that the upper edge is disposed substantially at a focus of the second lens.

6. The vehicle light according to claim 5, wherein at least one of the first and second light shielding shutters has a first upper edge portion of the upper edge near an opposite vehicle road side located higher than a second upper edge portion of the upper edge near a travelling road side.

7. The vehicle light according to claim 2, further comprising:

a third lens disposed below, and forward, of the second lens; and a third reflector disposed below, and forward, of the second reflector, and wherein the third reflector is configured to reflect light beams from the LED light source toward the third lens so as to form a vertically converged and horizontally diffused spot light distribution pattern.

8. The vehicle light according to claim 4, further comprising:

a third lens disposed below, and forward of the second lens; and a third reflector disposed below, and forward of the second reflector, and wherein the third reflector is configured to reflect light beams from the LED light source toward the third lens so as to form a vertically converged and horizontally diffused spot light distribution pattern.

9. The vehicle light according to claim 5, further comprising:

a third lens disposed below, and forward, of the second lens; and a third reflector disposed below, and forward, of the second reflector, and wherein the third reflector is configured to reflect light beams from the LED light source toward the third lens so as to form a vertically converged and horizontally diffused spot light distribution pattern.

10. The vehicle light according to claim 6, further comprising:

a third lens disposed below, and forward, of the second lens; and a third reflector disposed below, and forward, of the second reflector, and wherein the third reflector is configured to reflect light beams from the LED light source toward the third lens so as to form a vertically converged and horizontally diffused spot light distribution pattern.

11. The vehicle light according to claim 3, further comprising:

a third lens disposed above, and forward, of the second lens; and a third reflector disposed above, and forward, of the second reflector, and wherein the third reflector is configured to reflect light beams from the LED light source toward the third lens so as to form a vertically converged and horizontally diffused spot light distribution pattern.

12. The vehicle light according to claim 7, further comprising:

fourth lenses disposed below and forward of the first lens and on either side of the second lens; and a fourth reflector disposed above the first reflector and the fourth lens so as to extend to cover both sides of the LED light source, and wherein the fourth reflector is configured to reflect light beams from the LED light source toward the fourth lens so as to form a vertically converged and horizontally diffused additional middle-area light distribution pattern.

13. The vehicle light according to claim 8, further comprising:

fourth lenses disposed below and forward of the first lens and on either side of the second lens; and a fourth reflector disposed above the first reflector and the fourth lens so as to extend to cover both sides of the LED light source, and wherein the fourth reflector is configured to reflect light beams from the LED light source toward the fourth lens so as to form a vertically converged and horizontally diffused additional middle-area light distribution pattern.

14. The vehicle light according to claim 9, further comprising:

fourth lenses disposed below and forward of the first lens and on either side of the second lens; and a fourth reflector disposed above the first reflector and the fourth lens so as to extend to cover both sides of the LED light source, and wherein the fourth reflector is configured to reflect light beams from the LED light source toward the fourth lens so as to form a vertically converged and horizontally diffused additional middle-area light distribution pattern.

15. The vehicle light according to claim 10, further comprising:

fourth lenses disposed below and forward of the first lens and on either side of the second lens; and a fourth reflector disposed above the first reflector and the fourth lens so as to extend to cover both sides of the LED light source, and wherein the fourth reflector is configured to reflect light beams from the LED light source toward the fourth lens so as to form a vertically converged and horizontally diffused additional middle-area light distribution pattern.

16. The vehicle light according to claim 12, further comprising:

fifth lenses disposed on either side of the third lens; and fifth reflectors disposed on either side of the third reflector, and wherein each of the fifth reflectors is configured to reflect light beams from the LED light source toward a respective one of the fifth lenses so as to form a horizontally diffused overhead-sign visible light distribution pattern.

17. The vehicle light according to claim 13, further comprising:

fifth lenses disposed on either side of the third lens; and fifth reflectors disposed on either side of the third reflector, and wherein each of the fifth reflectors is configured to reflect light beams from the LED light source toward a respective one of the fifth lenses so as to form a horizontally diffused overhead-sign visible light distribution pattern.

18. The vehicle light according to claim 14, further comprising:

fifth lenses disposed on either side of the third lens; and fifth reflectors disposed on either side of the third reflector, and wherein each of the fifth reflectors is configured to reflect light beams from the LED light source toward a respective one of the fifth lenses so as to form a horizontally diffused overhead-sign visible light distribution pattern.

19. The vehicle light according to claim 15, further comprising:

fifth lenses disposed on either side of the third lens; and fifth reflectors disposed on either side of the third reflector, and wherein each of the fifth reflectors is configured to reflect light beams from the LED light source toward a respective one of the fifth lenses so as to form a horizontally diffused overhead-sign visible light distribution pattern.

20. The vehicle light according to claim 2, wherein at least one of the first lens and the second lens is shaped in an upper-half lens shape above or almost above an optical axis of a respective one of the first lens and the second lens.

21. The vehicle light according to claim 4, wherein at least one of the first lens and the second lens is shaped in an upper-half lens shape above or almost above an optical axis of a respective one of the first lens and the second lens.

22. The vehicle light according to claim 5, wherein at least one of the first lens and the second lens is shaped in an upper-half lens shape above or almost above an optical axis of a respective one of the first lens and the second lens.

23. The vehicle light according to claim 6, wherein at least one of the first lens and the second lens is shaped in an upper-half lens shape above or almost above an optical axis of a respective one of the first lens and the second lens.

24. The vehicle light according to claim 7, wherein at least one of the first lens and the second lens is shaped in an upper-half lens shape above or almost above an optical axis of a respective one of the first lens and the second lens.

25. The vehicle light according to claim 12, wherein at least one of the first lens and the second lens is shaped in an upper-half lens shape above or almost above an optical axis of a respective one of the first lens and the second lens.

26. The vehicle light according to claim 16, wherein at least one of the first lens and the second lens is shaped in an upper-half lens shape above or almost above an optical axis of a respective one of the first lens and the second lens.

27. The vehicle light according to claim 3, wherein at least one of the first lens and the second lens is shaped in a lower-half lens shape above or almost above an optical axis of a respective one of the first lens and the second lens.

28. The vehicle light according to claim 11, wherein at least one of the first lens and the second lens is shaped in a lower-half lens shape above or almost above an optical axis of a respective one of the first lens and the second lens.

29. The vehicle light according to claim 2, wherein the first lens is formed as a horizontally elongate upper-half toroidal lens portion, the upper-half toroidal lens portion being above or almost above an optical axis of the first lens, and wherein the toroidal lens portion is configured by horizontally extending an aspherical lens cross section having a focus near the LED light source in an arc shape.

30. The vehicle light according to claim 2, wherein the second lens is formed as a horizontally elongate upper-half toroidal lens portion, the upper-half toroidal lens portion being above or almost above an optical axis of the second lens, and wherein the toroidal lens portion is configured by horizontally extending an aspherical lens cross section having a focus near the LED light source in an arc shape.

31. The vehicle light according to claim 2, wherein the first lens is formed as a horizontally elongate upper-half cylindrical lens portion, the upper-half cylindrical lens portion being above or almost above an optical axis of the first lens, and wherein the cylindrical lens portion has a horizontally extended focus line near the LED light source.

32. The vehicle light according to claim 2, wherein the second lens is formed as an horizontally elongate upper-half cylindrical lens portion, the upper-half cylindrical lens portion being above or almost above an optical axis of the second lens, and wherein the cylindrical lens portion has a horizontally extended focus line near the LED light source.

33. A vehicle light, comprising an LED light source;

a first lens configured as at least part of one of a toroidal lens and a cylindrical lens, the toroidal lens being configured by horizontally extending an aspherical lens cross section having a focus near the LED light source in an arc shape, the cylindrical lens having a horizontally extended focus line near the LED light source;

a reflector disposed at a position opposite to the first lens with the LED light source located between the reflector and the first lens, the reflector configured to reflect light beams from the LED light source toward the first lens so as to form a predetermined light distribution pattern; and a light shielding shutter that has an upper edge, the light shielding shutter located between the first lens and the reflector so that the upper edge is disposed substantially at a focus of the first lens, the light shielding shutter having a first upper edge portion of the upper edge and a second upper edge portion of the upper edge, with the first upper edge portion located higher relative to the second upper edge portion.

34. The vehicle light according to claim 33, wherein the LED light source has an optical axis extending along a light emitting direction and the LED light source is disposed such that the optical axis is directed downward, and wherein the reflector extends from both sides of the LED light source to a position near the optical axis of the LED light source, the reflector configured to reflect light beams from the LED light source toward the first lens so as to form a vertically converged and horizontally diffused predetermined light distribution pattern.

35. The vehicle light according to claim 33, wherein the reflector is a revolved ellipsoidal reflector having a first focus and a second focus, the first focus located substantially at the LED light source, and the second focus located between the first lens and the reflector.

36. The vehicle light according to claim 34, wherein the reflector is a revolved ellipsoidal reflector having a first focus and a second focus, the first focus located substantially at the LED light source, and the second focus located between the first lens and the reflector.

* * * * *